US010530054B2

(12) United States Patent
Urzhumov

(10) Patent No.: US 10,530,054 B2
(45) Date of Patent: Jan. 7, 2020

(54) APERTURE EFFICIENCY ENHANCEMENTS USING HOLOGRAPHIC AND QUASI-OPTICAL BEAM SHAPING LENSES

(71) Applicant: Searete LLC, Bellevue, WA (US)

(72) Inventor: Yaroslav A. Urzhumov, Bellevue, WA (US)

(73) Assignee: Searete LLC, Bellevue, WA (US)

( * ) Notice: Subject to any disclaimer, the term of this patent is extended or adjusted under 35 U.S.C. 154(b) by 115 days.

(21) Appl. No.: 15/801,164

(22) Filed: Nov. 1, 2017

(65) Prior Publication Data

US 2019/0131704 A1 May 2, 2019

(51) Int. Cl.

| | |
|---|---|
| ***H01Q 3/26*** | (2006.01) |
| ***H01Q 19/06*** | (2006.01) |
| ***H01Q 15/14*** | (2006.01) |
| ***H01Q 13/02*** | (2006.01) |
| ***H01Q 15/08*** | (2006.01) |
| ***H01Q 19/08*** | (2006.01) |
| ***H01Q 19/13*** | (2006.01) |
| ***H01Q 19/19*** | (2006.01) |

(52) U.S. Cl.

CPC ..... *H01Q 3/2676* (2013.01); *H01Q 13/02* (2013.01); *H01Q 15/08* (2013.01); *H01Q 15/14* (2013.01); *H01Q 19/067* (2013.01); *H01Q 19/08* (2013.01); *H01Q 19/132* (2013.01); *H01Q 19/19* (2013.01)

(58) Field of Classification Search

CPC ..... H01Q 3/2676; H01Q 15/14; H01Q 3/26; H01Q 13/02; H01Q 15/08; H01Q 19/06; H01Q 19/067; H01Q 19/08; H01Q 19/132; H01Q 19/19

See application file for complete search history.

(56) References Cited

U.S. PATENT DOCUMENTS

| | | | | |
|---|---|---|---|---|
| 7,791,552 | B1 * | 9/2010 | Romanofsky ..... | H01Q 15/148 343/700 MS |
| 2006/0187137 | A1 * | 8/2006 | Waltman ..... | H01Q 19/132 343/840 |
| 2009/0267850 | A1 * | 10/2009 | Parsche ..... | H01Q 15/0006 343/742 |

OTHER PUBLICATIONS

Shin, Dongheok, et al., Broadband Electromagnetic Cloaking with Smart Metamaterials, Nature Communications, Nov. 20, 2012, p. 1-8, 3:1213 doi: 10.1038/ncomms2219, Macmillan Publishers Limited.

Hunt, John, et al., Broadband Wide Angle Lens Implemented with Dielectric Metamaterials, Sensors, Aug. 11, 2011, p. 7982-7991, doi: 10.3390/s110807982, MDPI, Basel, Switzerland.

(Continued)

*Primary Examiner* — Hoang V Nguyen

(74) *Attorney, Agent, or Firm* — Phillips, Ryther & Winchester; Justin K. Flanagan

(57) ABSTRACT

A conversion device for converting between electric power and electromagnetic waves, such as an RF antenna, may be fitted with an intermediary holographic lens to modify a radiation pattern between an electromagnetic radiation (EMR) reflector to reflect EMR and an EMR feed. The holographic lens may modify a performance metric associated with the conversion device. The holographic lens may have a volumetric distribution of dielectric constants. For example, a voxel-based discretization of the distribution of dielectric constants can be used to generate the holographic lens.

40 Claims, 27 Drawing Sheets

(56) References Cited

OTHER PUBLICATIONS

Larouche, Stephane, et al., Infrared Metamaterial Phase Holograms, Nature Materials, Mar. 18, 2012, p. 450-454, vol. 11, Duke University, Durham, North Carolina, USA.
Larouche, Stephane, et al., Infrared Metamaterial Phase Hologram—Supplementary Information, Nature Materials, 2012, p. 1-3, doi: 10.1038/NMAT3278, Macmillan Publishers Limited.
Daukantas, Patricia, Printable Invisibility Cloak: Disk Renders Microwaves Nearly Undetectable, Optics & Photonics News, Jul./Aug. 2013, p. 10, The Optical Society, USA.
Driscoll, Tom, et al., Performance of a Three Dimensional Transformation-optical-flattened Luneburg Lens, Optics Express, Jun. 4, 2012, p. 13262-13273, vol. 20, No. 12, Optical Society of America, USA.
Urzhumov, Yaroslav, et al., Realization of Multidirectional Microwave Cloaks Based on Thin Dielectric Coatings, Piers 2013: Progress in Electromagnetics Research Symposium, Aug. 12-15, 2013, Stockholm, Sweden.
Hunt, John, et al., Planar, Flattened Luneburg Lens at Infrared Wavelengths, Optics Express, p. 1706-1713, Jan. 16, 2012, vol. 20, No. 2, Optical Society of America, USA.
Urzhumov, Yaroslav, et al., Thin Low-Loss Dielectric Coatings for Free-Space Cloaking, Optics Letters, p. 1606-1608, May 15, 2013, vol. 38, No. 10, Optical Society of America, USA.

* cited by examiner

200

400

600

APERTURE EFFICIENCY ENHANCEMENTS USING HOLOGRAPHIC AND QUASI-OPTICAL BEAM SHAPING LENSES

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)). In addition, the present application is related to the "Related Applications," if any, listed below.

PRIORITY APPLICATIONS

NONE

RELATED APPLICATIONS

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc., applications of the Priority Applications and the Related Applications, including any priority claims, is incorporated herein by reference to the extent such subject matter is not inconsistent herewith.

TECHNICAL FIELD

This disclosure relates to dielectric lenses to improve aperture efficiency conversion between free-space waves and electrical power. For example, a holographic lens with a volumetric distribution of dielectric constants can be used to modify a radiation pattern between an RF feed and RF beamformer.

DETAILED DESCRIPTION

Figure 1A:
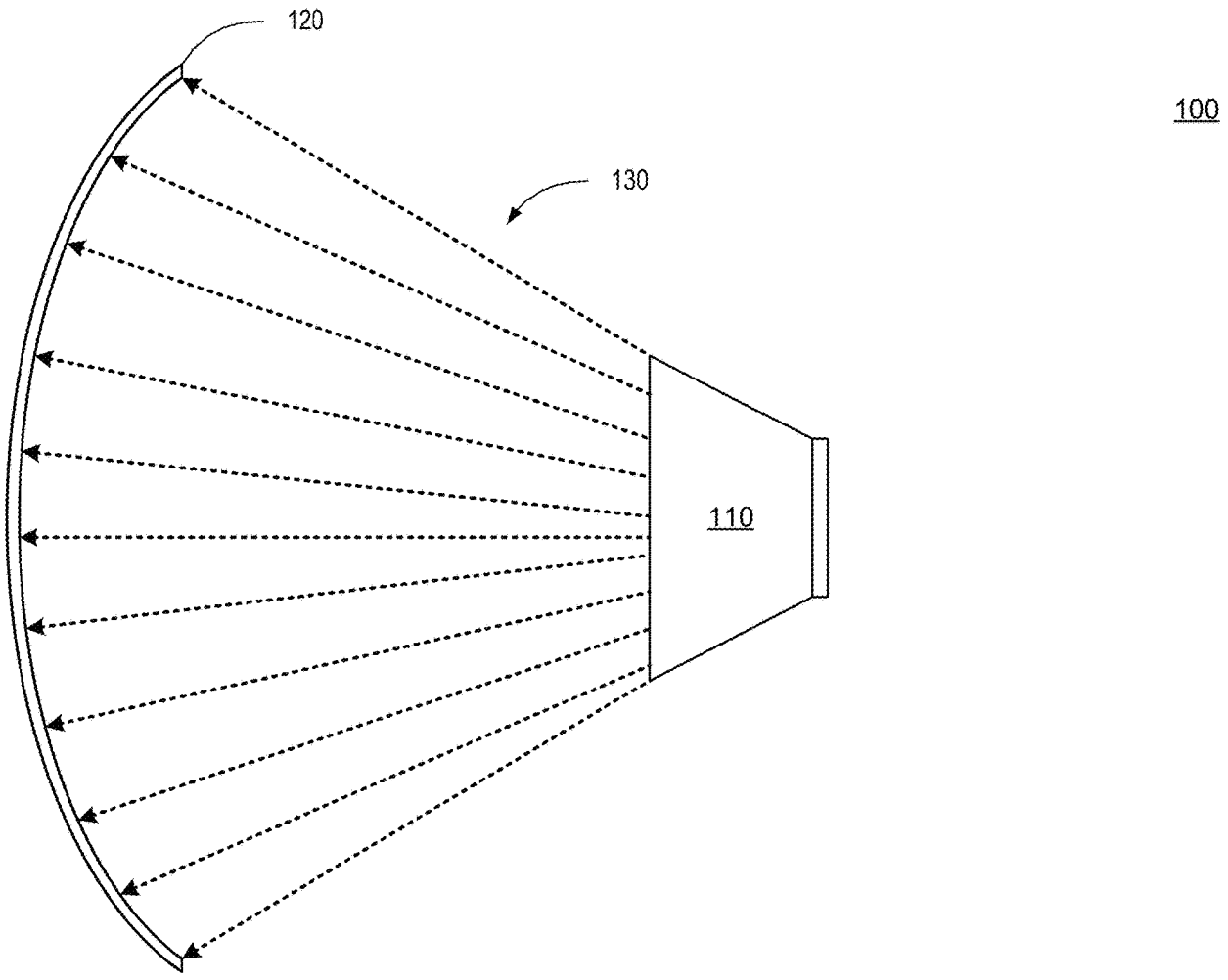
FIG. 1A illustrates an example of an RF feed and a parabolic reflector.

According to various embodiments, systems, apparatuses and methods are described herein that relate to holographic lenses configured to modify field or radiation patterns of electromagnetic radiation (EMR) devices. Many of the examples provided herein, including many of the figures, relate to radio frequency (RF) EMR. However, it is appreciated that the various embodiments and principles described herein can be utilized or adapted for use with other spectral ranges of EMR.

A holographic lens generated with a volumetric distribution of dielectric constants can be used to shape a radiation pattern to increase aperture efficiency of various types of antenna configurations. In some embodiments, the holographic lens may modify the field pattern to compensate or negate the effects of a re-radiating or energy-absorbing object in the near-field or far-field.

The distribution of dielectric constants and the materials used in the holographic lens may be selected for a particular frequency band and to accomplish a target radiation pattern modification. In various embodiments, the holographic lens may be idealized as a graded-permittivity structure having a continuous distribution of dielectric constants, such that there are no abrupt changes in permittivity across the structure. Given the finite bandwidth of typical antenna systems, a discretized piecewise-continuous approximation of the graded-permittivity structure may be electromagnetically equivalent for a given bandwidth.

Thus, in various embodiments, the holographic lens may be divided into a plurality of sub-wavelength voxels. That is, the holographic lens may be conceptually thought of as comprising a plurality of voxels (three-dimensional pixels) whose largest dimension in at least one direction is smaller than a wavelength within the relevant bandwidth. For example, each voxel may have a maximum dimension in at least one direction that is less than half of a wavelength (e.g., the smallest wavelength) within an operational frequency range. The holographic lens may be referred to as a holographic metamaterial device useful to modify the radiation pattern between an RF feed and, for example, an RF reflector for a particular frequency range.

In some embodiments, the voxels may be cubes, parallelepipeds, tetrahedrons, prisms, various regular polyhedrons, or other polyhedrons. In some embodiments, a voxel may have one or two dimensions that are sub-wavelength while the other dimension(s) are larger than a wavelength.

In various embodiments, a combination of voxel shapes and/or sizes may be used. Moreover, voxels may be shaped and/or sized such that little or no space, gaps, or voids exist between voxels. Alternatively, voxels may be arranged such that gaps or voids of various sizes and/or shapes exist intentionally. In some embodiments, the gaps or voids may be ignored and/or negligible in calculating the volumetric dielectric constants. Alternatively, the gaps or voids may be assigned one or more dielectric constants corresponding to a vacuum or to air or another fluid that fills the gaps or voids.

The holographic lens may be conceptually discretized to facilitate the use of optimization algorithms, while the physically constructed holographic lens may not be physically discretized. In other embodiments, the holographic lens may be physically discretized (e.g., a holographic lens may be printed using a three-dimensional printer). Additional examples of optimizations and calculations for determining distributions of dielectric constants are described in U.S. patent application Ser. No. 14/638,961 filed on Mar. 4, 2015, titled "Holographic Mode Conversion for Electromagnetic Radiation," which application and all applications that claim priority thereto are hereby incorporated by reference in their entireties.

EMR antenna system (e.g., an RF, infrared, optical, etc. antenna system) may generally be configured to convert between electric power and EMR signals, such as those traveling in air or a vacuum (referred to herein as free-space). The EMR antenna system may include an EMR beamformer, such as an EMR reflector or an EMR lens. An EMR feed may have a radiation pattern relative to the EMR beamformer. In a transmitting state, the EMR feed may transmit an EMR signal with the radiation pattern to the EMR beamformer. The EMR beamformer may reflect (in the case of an RF reflector) or refract (in the case of an EMR lens) the EMR signal based on the characteristics of the EMR beamformer.

The radiation pattern of the EMR feed relative to the EMR beamformer may be associated with one or more performance metrics. For example, the radiation pattern of the EMR feed relative to the EMR beamformer may be characterized by a performance metric relating to aperture efficiency, maximum peak directivity, equivalent isotropic radiated power (EIRP), an angular resolution of the radiation pattern, and/or the like. The radiation pattern between the EMR feed and the EMR beamformer impacts the efficiency of the antenna system. For example, spillover energy that "spills" over the edges of a reflector is wasted and decreases overall efficiency. However, a narrowly focused radiation pattern may not utilize the full aperture of the EMR beamformer, thereby decreasing available directivity in the far-field. Decreased directivity in the far-field may lower the overall efficiency of the antenna system.

A holographic lens may be retrofitted as part of the EMR antenna system. Alternatively, a holographic lens may be manufactured as part of an EMR antenna system. As previously described, the holographic lens may include a volumetric distribution of dielectric constants. The holographic lens, or at least a portion of it, may be positioned between (i.e., on, in, around, etc.) the EMR beamformer and the EMR feed to modify the radiation pattern and adjust one or more performance metrics.

In some embodiments, the holographic lens may have a volumetric distribution of dielectric constants tailored to, for example, reduce spillover feed power. For example, the antenna system may include a feed horn and parabolic dish reflector. The radiation pattern between the feed horn and the parabolic dish reflector may include significant spillover energy, as explained in greater detail below. The holographic lens may modify the radiation pattern to reduce the spillover feed power.

The holographic lens may be configured to modify an illumination taper of the radiation pattern incident on the EMR beamformer. For instance, the holographic lens may increase incident power density at an outer edge of the EMR beamformer relative to the mean power density at the EMR beamformer. Alternatively, the holographic lens may increase incident power density at the center, in a ring, in a target quadrant or sub-portion, and/or at another location of the EMR beamformer.

Generally speaking, an antenna system may have a default or standard radiation pattern between an EMR feed and an EMR beamformer. A holographic lens may be fitted between the EMR feed and the EMR beamformer to modify the radiation pattern to attain a target radiation pattern. The target radiation pattern may, for example, have less spillover, increased uniformity, decreased uniformity, increased energy density toward the edges of the EMR beamformer, etc.

Again, many of the examples used herein describe the system and methods in the context of an RF antenna system.

However, it is appreciated that the systems and methods described herein may be applied to a wide variety of reflective-type conversion devices for converting between electric power and electromagnetic waves. For example, the systems and methods described herein may be applied to an infrared device configured to convert between infrared light and electric power.

In the general sense, a reflective-type conversion device may include an EMR reflector to reflect EMR. The conversion device may further include an EMR feed with a radiation pattern relative to the EMR reflector. The radiation pattern may be characterized by one or more performance metrics. A holographic lens may be fitted, at least partially, between the EMR reflector and the EMR feed to modify the radiation pattern relative to the EMR reflector to modify the performance metric. For example, the holographic lens may be fitted to the EMR reflector, to the EMR feed, between the EMR reflector and the EMR feed without touching either of them, or physically connected to both the EMR reflector and the EMR feed.

Similarly, the presently-described systems and methods may be utilized in conjunction with aperture-type conversion devices as well. An aperture-type conversion device may be configured to convert between electric power and electromagnetic waves similar to a reflective-type conversion device. Again, an intermediary holographic lens may modify a radiation pattern between a large-aperture transmissive aperture and an EMR feed. One example of a large-aperture transmissive aperture is a lens.

The presently-described systems and methods may work in connection with EMR reflectors and/or transmissive apertures with active gain elements configured to amplify incident EMR. The holographic lens, in some embodiments, may modify the radiation pattern to generate a reverse taper with relative lower incident power density toward the center of the EMR reflector (or transmissive aperture) and relatively higher incident power density toward edge(s) of the EMR reflector (or transmissive aperture) to increase overall angular resolution of the antenna system.

As in the first example, the conversion device may be configured to convert between electric power and RF. The conversion device may be configured to work with microwave EMR, terahertz EMR, infrared EMR, visible light EMR, and/or ultraviolet EMR. The materials, shape, size, configuration, and other characteristics of the holographic lens may be adapted for the specific bandwidth of EMR.

The EMR reflector may be, for example, a parabolic dish, and the EMR feed may comprise an RF feed horn, a microwave antenna, a dipole antenna, an optical light emitter, a terahertz transceiver, a photodiode, or the like. In some embodiments, the EMR feed may function as both a transmitter and a receiver. In other embodiments, the conversion device may be configured to function as only a transmitter or as only a receiver, in which case the EMR feed may be configured to operate as either a transmitter or a receiver in the applicable bandwidth of EMR.

The holographic lens may, for example, modify a field pattern between the EMR feed and the EMR reflector (or transmissive aperture) to modify one or more performance metrics. For example, the radiation pattern of the EMR feed relative to the EMR reflector (or transmissive aperture) may normally have a higher energy density toward a center of a reflector that tapers off toward the edges of the reflector to minimize spillover. A holographic lens may be positioned between the EMR feed and the EMR reflector (or transmissive aperture) to increase power radiated by the EMR feed at edges of the EMR reflector (or transmissive aperture) from between 9 dB and 11 dB relative to the center of the EMR reflector (or transmissive aperture) without an increase in spillover feed energy. In some embodiments, there may even be a reduction in spillover feed energy.

The holographic lens may be configured to produce a null or otherwise reduced incident power density at the EMR reflector corresponding to a known aperture blockage. For example, the EMR feed itself may block EMR reflected by the EMR reflector at some locations. Accordingly, the holographic lens may be configured to redistribute the energy that would have been radiated to (or from) the portion of the EMR reflector that is blocked or at least partially blocked.

The EMR reflector (or transmissive aperture) may be active or passive. For instance, the EMR reflector may comprise a reflectarray that includes phase-tunable elements. In some embodiments, the EMR reflector may be planar. A metamaterial EMR reflector may be planar but have reflective properties such that it behaves as a parabolic dish at some frequency bands. The systems and methods described herein may be utilized with EMR reflectors of all shapes and sizes, including, without limitation, circular reflectors, dish reflectors, rectangular reflectors, paraboloidal dishes, ellipsoidal dishes, a surface of revolution, etc. An antenna system may be a Cassegrainian, Gregorian, or multi-reflector assembly. In some embodiments, one or more shrouds may be utilized to reduce side lobes.

In some embodiments, the EMR feed and the EMR reflector (or transmissive aperture) may even be coaxial. The holographic lens may have a volumetric distribution of dielectric constants to: produce a null in the radiation pattern near a center of the EMR reflector; increase power density uniformity; decrease power density uniformity; reduce spillover, and/or attain other target radiation patterns.

In some embodiments, the distribution of dielectric constants may comprise a distribution of only dielectric materials. In other embodiments, the distribution of dielectric constants may include some conductive materials. The holographic lens may be porous and/or comprise foam, composite materials, fiber-bundles, stratified layers, micro-rod materials, nano-rod materials, and/or the like. In various embodiments, metamaterials may be utilized. For example, a metamaterial may be utilized that has an effective dielectric constant less than 1 and/or a complex permittivity value for an operational frequency range. Multiple different types of metamaterials may be utilized for various dielectric constants less than 1 and/or complex permittivity.

The holographic lens may have a uniform or variable thickness, may be configured to be inserted within a feed horn, wrap around an EMR feed, and/or be positioned proximate the EMR feed without touching it. As previously discussed, the holographic lens may be approximated by a plurality of voxels have varying permittivity values. Subwavelength voxels may be utilized to attain an effective dielectric constant distribution at specific bandwidths. Examples of suitable materials to construct a holographic lens having a target distribution of dielectric constants include, but are not limited to: porcelain, glass, plastic, air, nitrogen, sulfur hexafluoride, parylene, mineral oil, ceramic, paper, mica, polyethylene, and aluminum oxide.

The shape and dimensions of the holographic lens may be adapted based on the EMR feed and reflector used. In various embodiments, an EMR feed and/or reflector may include, by way of example but not limitation, a radio frequency antenna, an optical radiation transmitter, an optical radiation receiver, and/or an electro-optical EMR device configured to convert between electric current and optical radiation (e.g., from electric current to optical radiation, or from optical radiation to electric current).

The following specific examples use radio frequency (RF) antennas as an example of EMR devices generally. However, it is appreciated that many of the same concepts, embodiments, and general functionality of the systems and methods described herein are equally applicable to other frequency ranges of EMR, including those utilizing low-frequency RF, microwave, millimeter-wave, Terahertz, far and mid-infrared, near infrared, visible light, ultraviolet, x-rays, gamma rays, and so forth. It is appreciated that the sizes, dielectric values, materials, and other variables may be adjusted based on the particular spectrum in use.

Moreover, the generalized descriptions of the systems and methods herein may be utilized and/or adapted for utilization in a wide variety of industrial, commercial, and personal applications. For example, the systems and method described herein may be utilized in communication systems and in wireless power transfer systems. For instance, the systems and methods disclosed herein may be used to improve and/or enhance communication efficiency, or even viability, in a wide variety of EMR frequency bands.

Similarly, wireless power transfer may be improved (e.g., made possible, performed with increased efficiency, performed more safely, with reduced sidelobes, reduced backscatter, etc.). Wireless power transfer includes conversion to (or from) electrical power from (or to) any of a wide variety of EMR bands. For example, the systems and methods described herein can be used to modify a solar power collector. A solar power collector comprising an EMR beamformer and an EMR feed (e.g., in a collect mode) may be modified to include or manufactured to include a holographic lens to modify a performance metric of the solar power collector, according to many of the embodiments, described herein.

FIG. 1A illustrates an example of a radio frequency (RF) antenna system 100 that includes an RF feed 110 and a parabolic reflector 120. In the illustrated embodiment, the RF antenna system 100 is in a transmit mode in which RF signals 130 are transmitted from the RF feed 110 to the parabolic reflector 120. The idealized RF antenna system in FIG. 1A illustrates a uniform distribution of RF.

Figure 1B:
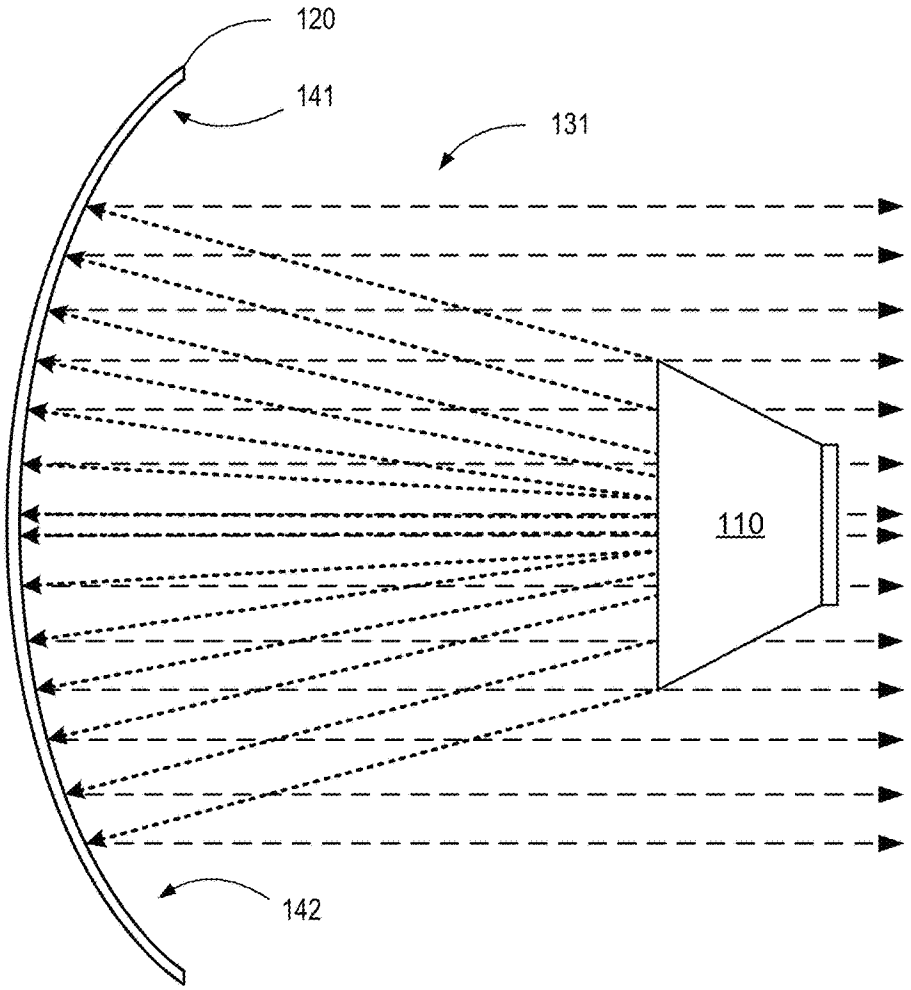
FIG. 1B illustrates an example of an inefficient radiation pattern of the RF feed relative to the parabolic reflector, in which the edges of the parabolic reflector are not fully utilized.

FIG. 1B illustrates an example of the RF antenna system 100 with an inefficient radiation pattern 131 of the RF feed 110 relative to the parabolic reflector 120, in which the outer edges 141 (e.g., an outer ring) of the parabolic reflector 120 are not fully utilized. As illustrated, in a transmit mode, focused radiation pattern 131 causes RF to be reflected from the RF reflector 120 as a focused beam into the far-field. In a receive mode, a similar illustration could be shown in which the directions of the arrows are reversed. In either case, the outer edges 141 and 142 of the parabolic reflector 120 are not fully utilized. It is generally appreciated that maximum directive gain (directivity) of an antenna depends on its physical size compared to wavelength. Utilizing less than the entire parabolic reflector results in reduced (or possibly eliminated) spillover losses, but may result in decreased overall efficiency due to the loss of directivity.

Figure 1C:
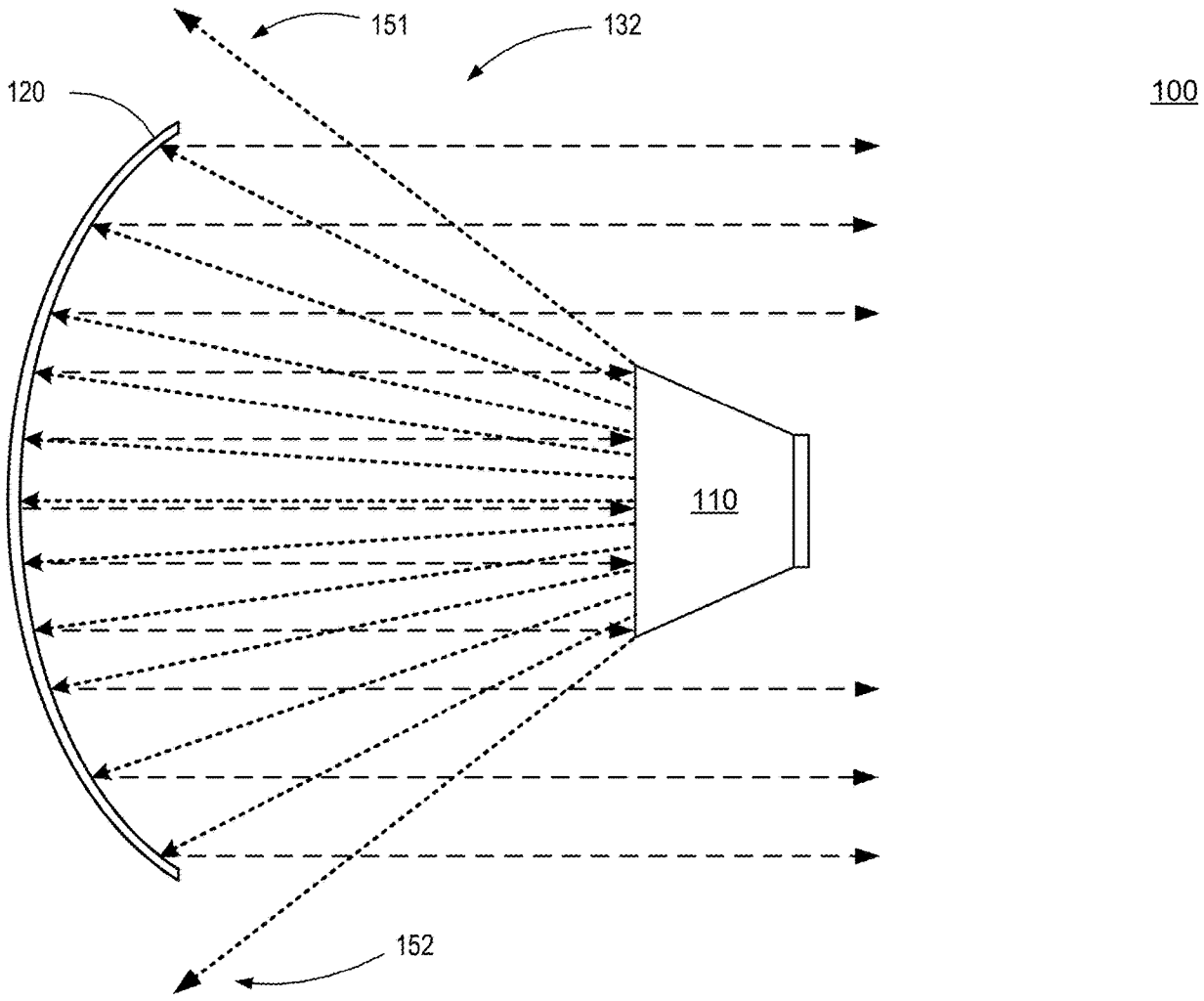
FIG. 1C illustrates an example of an inefficient radiation pattern of the RF feed relative to the parabolic reflector, in which the radiation pattern exhibits spillover on the edges of the parabolic reflector.

FIG. 1C illustrates an example of another inefficient radiation pattern 132 of the RF feed 110 relative to the parabolic reflector 120, in which the radiation pattern 132 exhibits spillover on the edges of the parabolic reflector 120. Such a configuration may increase the usage of the entire effective aperture of the RF antenna system 100 but result in spillover 151 and 152 at the edges of the parabolic reflector 120 (a ring of spillover in some embodiments). The spillover energy may decrease the overall efficiency of the RF antenna system 100.

Figure 1D:
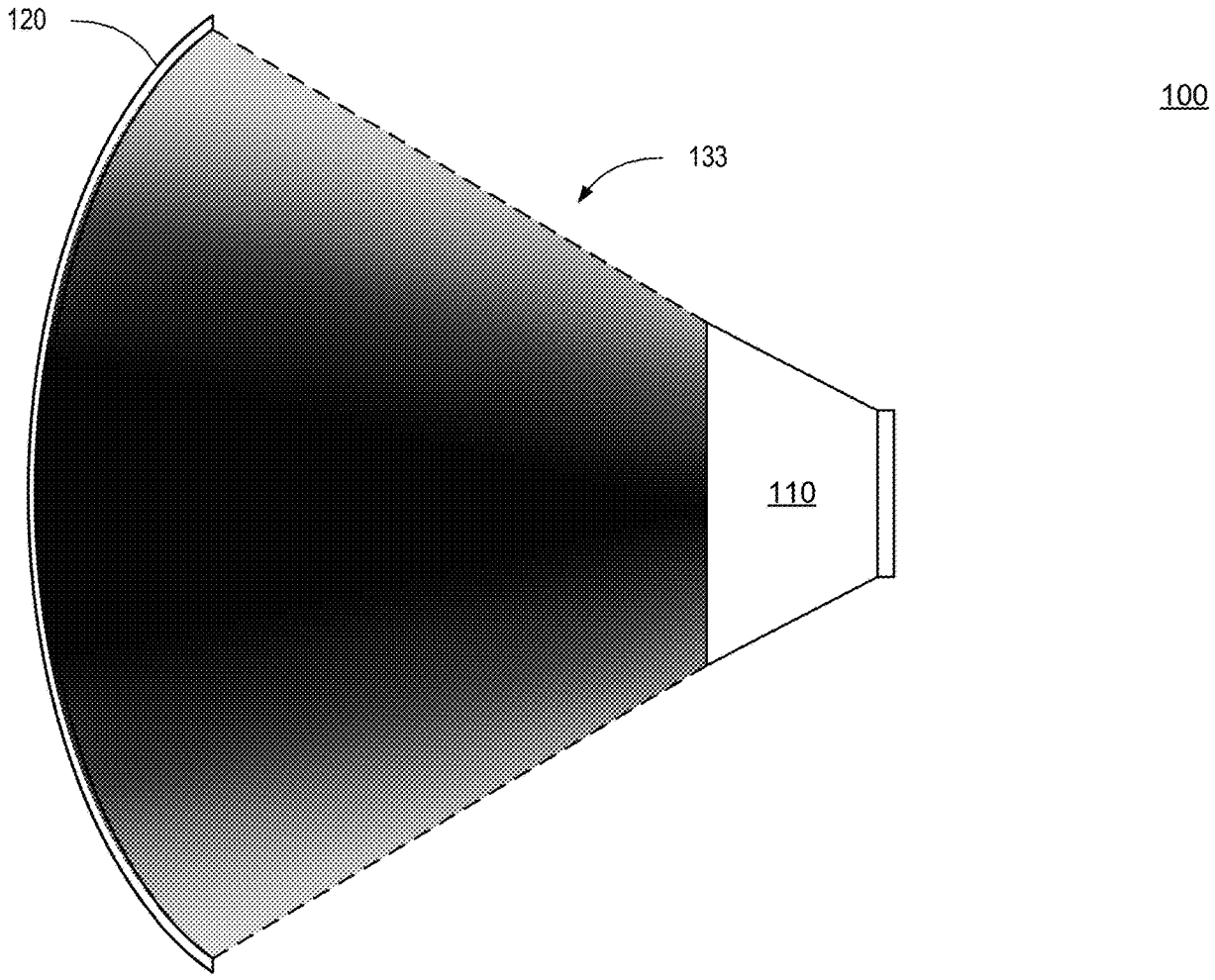
FIG. 1D illustrates an example of a radiation pattern of the RF feed relative to the parabolic reflector in which the energy density is higher at the center of the parabolic reflector than near the edges.

FIG. 1D illustrates an example of a radiation pattern 133 of the RF feed 110 relative to the parabolic reflector 120 in which the energy density is higher at the center of the parabolic reflector 120 than near the edges. Generally speaking, radiation patterns from RF feeds have a maximum energy density toward a center of a radiation pattern that tapers off in energy density toward the edges of the radiation pattern. Thus, to utilize the outer edges of the parabolic reflector 120, either significant spillover is introduced, or a relatively low percentage of the energy is reflected from the edges.

Figure 1E:
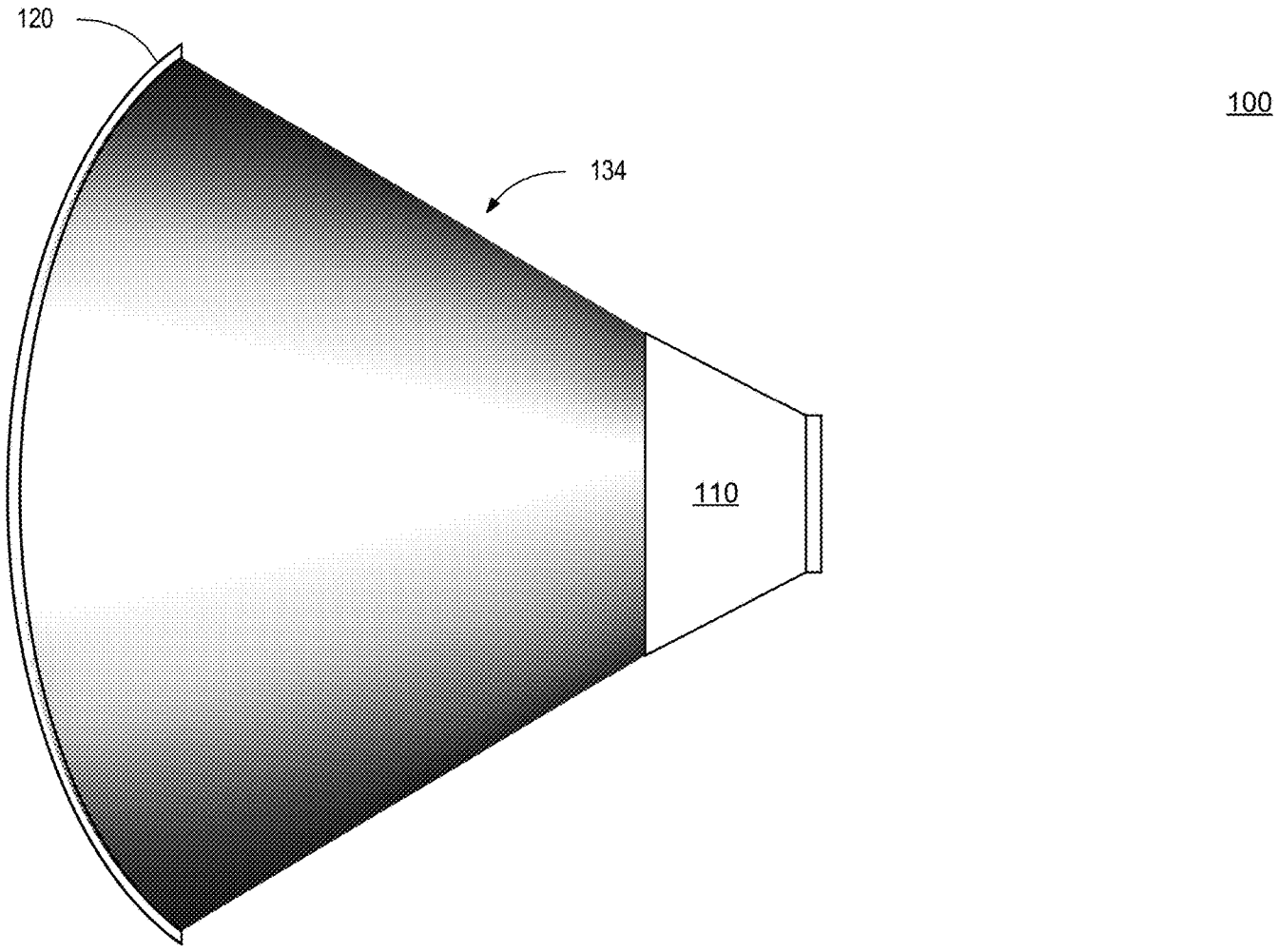
FIG. 1E illustrates an example of a radiation pattern of the RF feed relative to the parabolic reflector in which the energy density is higher at the edges of the parabolic reflector than near the center.

FIG. 1E illustrates an example of a radiation pattern 134 of the RF feed 110 relative to the parabolic reflector 120 in which the energy density is higher at the edges of the parabolic reflector 120 than near the center. The illustrated embodiment shows an idealized radiation pattern 134 in which no spillover is exhibited and a high percentage of the energy density is allocated to the extremes of the effective aperture of the RF antenna system 100. An RF feed 110 cannot generally be configured to provide such a radiation pattern by itself.

The systems and methods disclosed herein described a variety of approaches to approximate such a radiation pattern using a holographic lens. Minimizing spillover while maximizing the effective aperture of the RF antenna system can result in improved antenna efficiency.

Figure 1F:
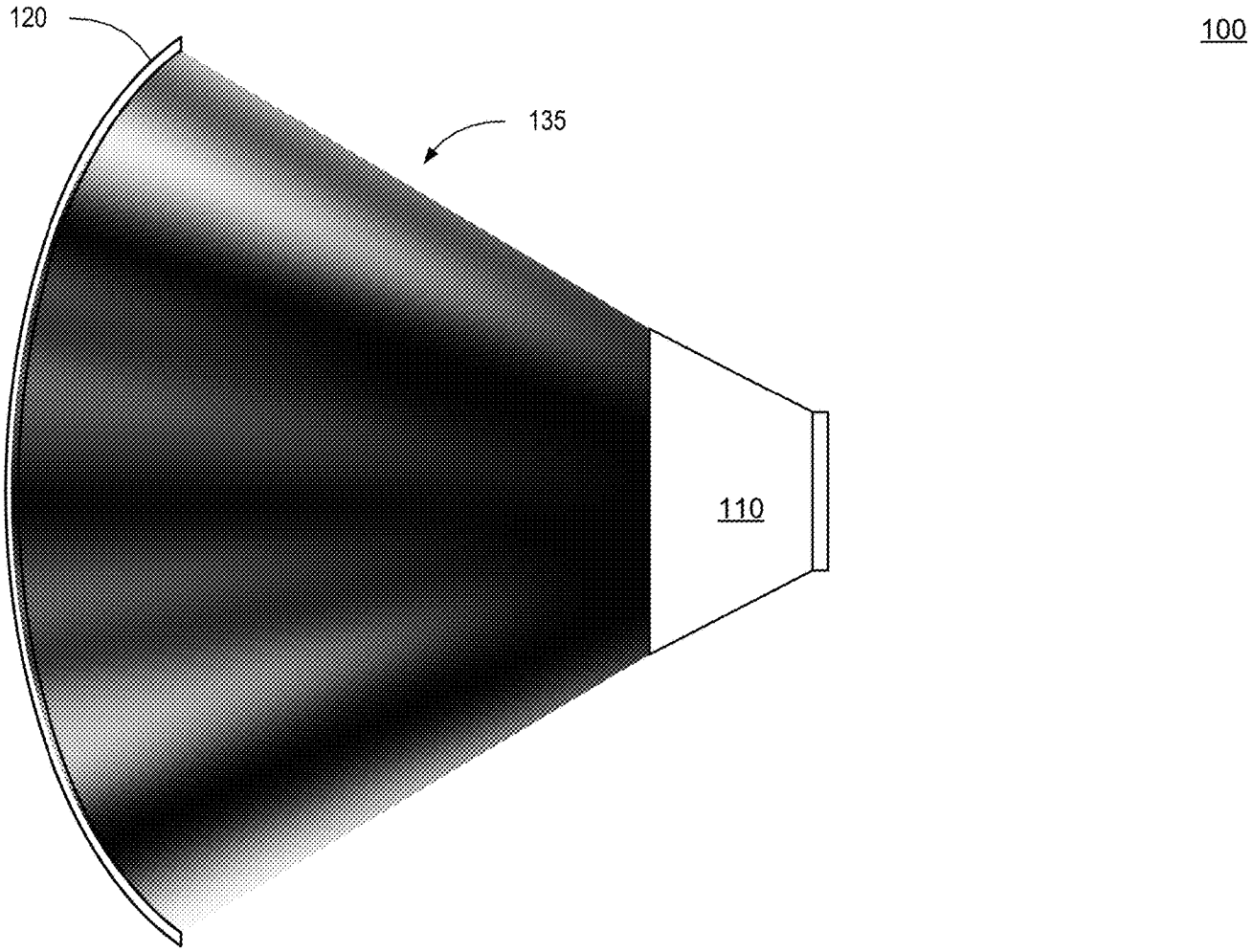
FIG. 1F illustrates an example of a radiation pattern of the RF feed relative to the parabolic reflector with an uneven energy density distribution.

FIG. 1F illustrates an example of a target radiation pattern 135 of the RF feed 120 relative to the parabolic reflector 120 with an uneven energy density distribution. The target radiation pattern 135 may be selected for a particular purpose—e.g., to reduce noise, control sidelobes, control scattering, reduce scattering, etc. The illustrated embodiment exemplifies the concept that controlled radiation patterning via a holographic lens can be utilized to create a radiation pattern between an EMR feed and an EMR beamformer (e.g., reflector or lens) for a wide variety of reasons, goals, and end results.

Figure 2:
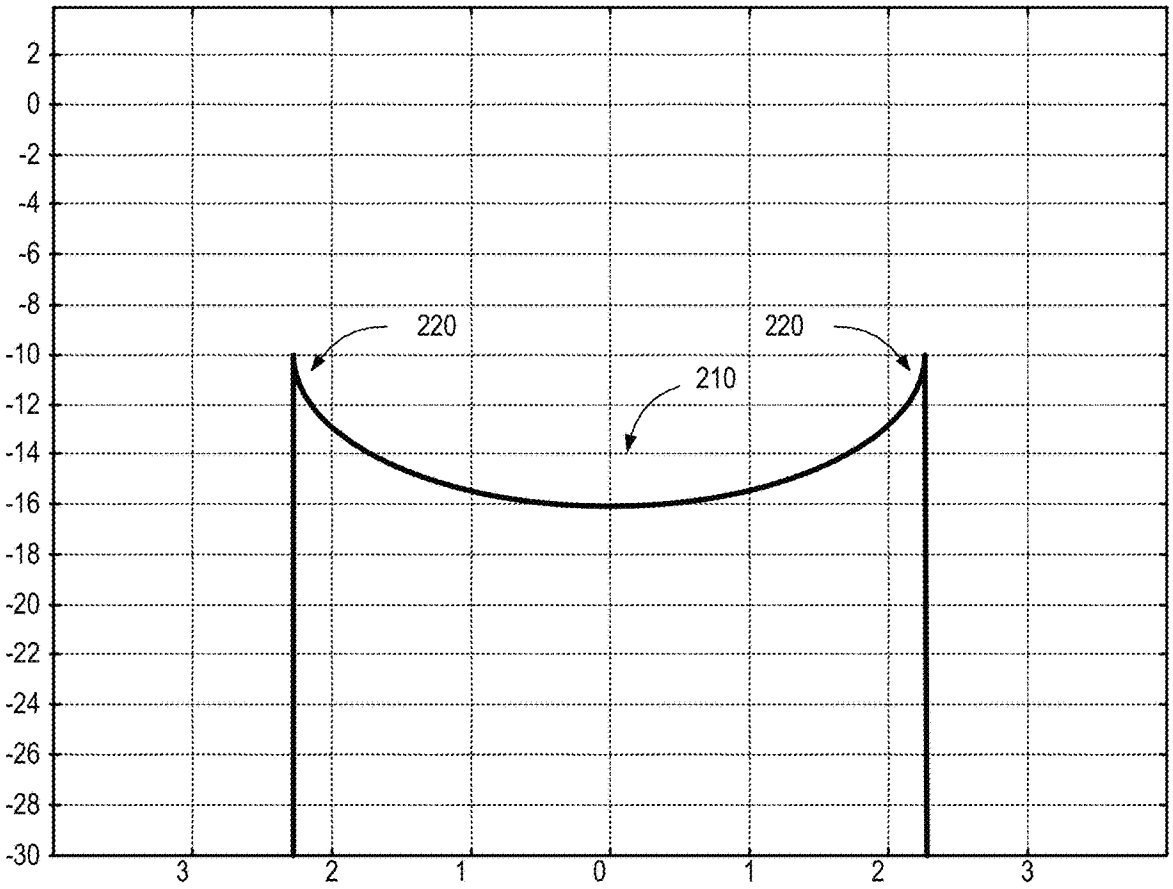
FIG. 2 illustrates an example of a distribution of power of a radiation pattern between an RF feed and a reflector using a holographic lens to increase the energy density at the edges of the reflector while minimizing spillover.

FIG. 2 illustrates an example of a distribution of power of a radiation pattern 200 between an RF feed and a reflector using a holographic lens to increase the relative energy density at the edges 220 of the reflector as compared to the center 210 of the reflector while minimizing spillover. In the illustrated embodiment, the vertical falloff of energy density at the edges 220 indicates that spillover is completely eliminated.

In practice, an EMR feed by itself may produce a Gaussian distribution that would exhibit significant spillover if the 3 dB points of the Gaussian distribution were collocated with the edges 220 of the EMR beamformer. In contrast, the use of a holographic lens may allow for the reduction of the spillover and/or a relative increase in energy density at the edges 220 of the EMR beamformer (as opposed to the center as with a Gaussian distribution).

Figure 3A:
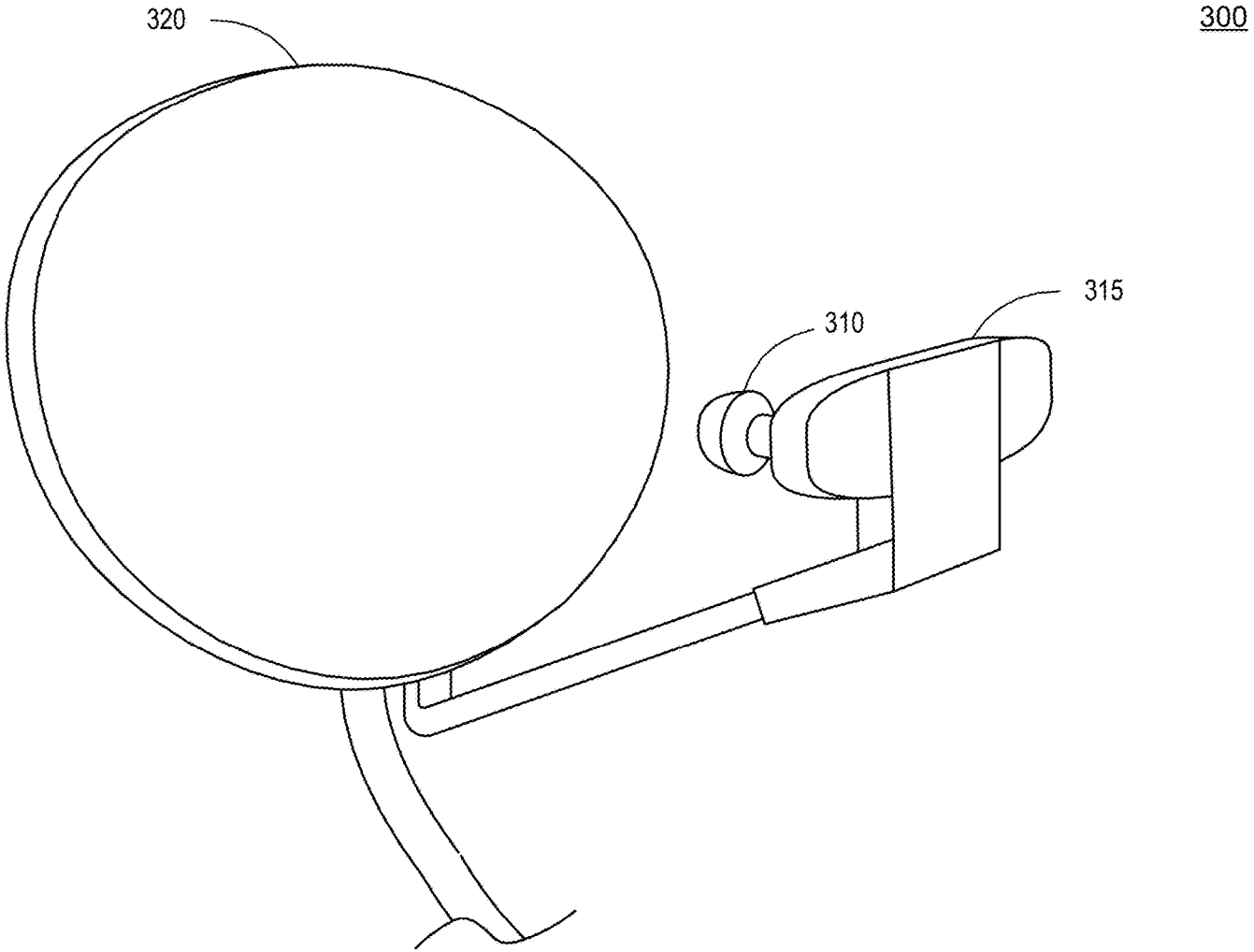
FIG. 3A illustrates a parabolic reflector and feed horn, such as might be used for microwave communications.

FIG. 3A illustrates a parabolic reflector 320 and feed horn 310, such as might be used for microwave or other RF communications. Similar antenna systems may be used for microwave communications, terahertz-frequency communications, optical communications, and/or other EMR communication bands. As illustrated, control circuitry 315 may be housed proximate the feed horn 310 to convert from RF to electrical signals in a receive mode and from electrical signals to RF in a transmit mode. A generally Gaussian radiation pattern may exist between the feed horn 310 and the parabolic reflector 320.

Figure 3B:
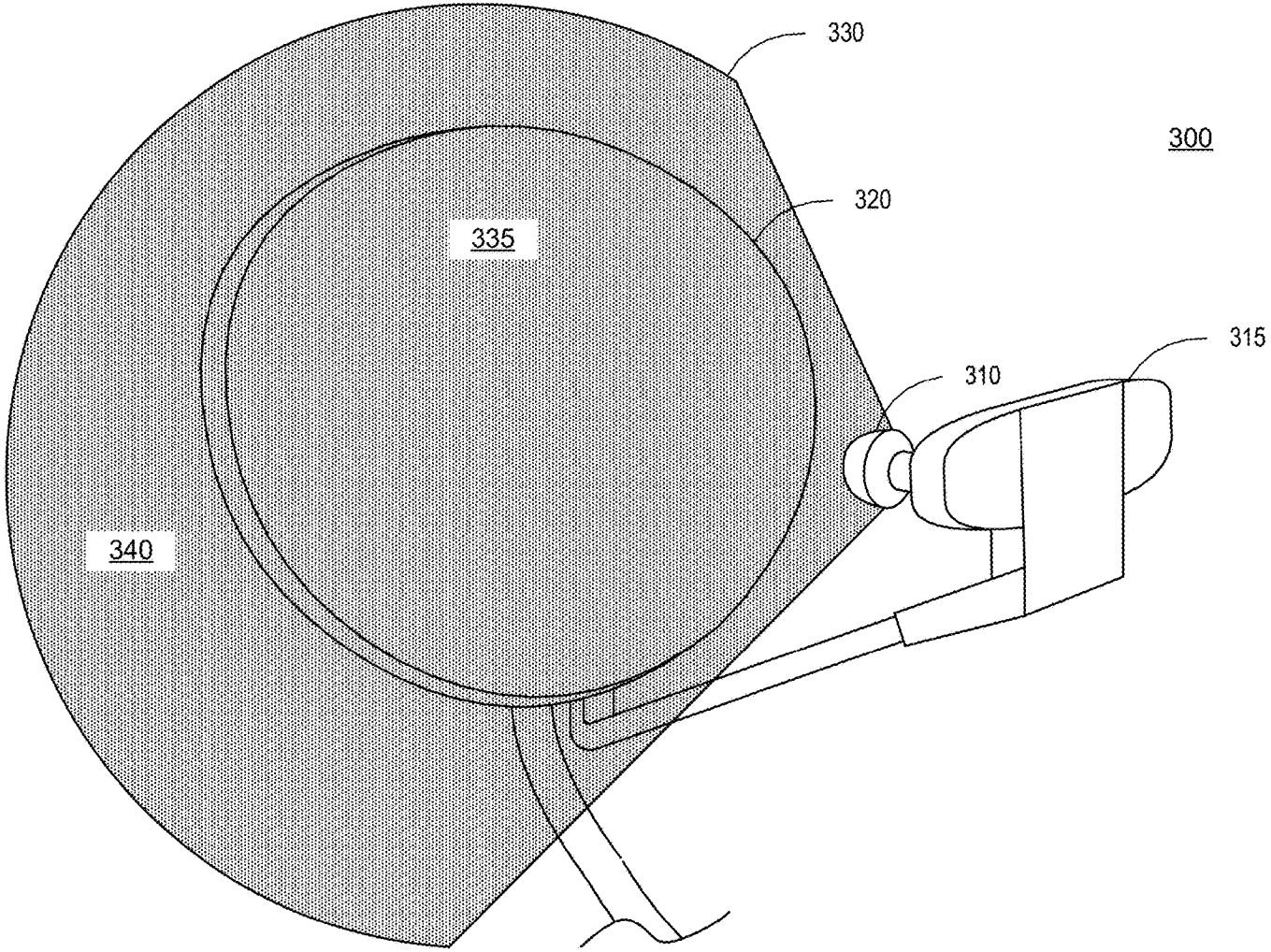
FIG. 3B illustrates a relatively inefficient radiation pattern between the feed horn and the parabolic reflector with significant spillover.

FIG. 3B illustrates a relatively inefficient radiation pattern 330 between the feed horn 310 and the parabolic reflector 320. The radiation pattern 330 includes a portion 335 that is reflected by the parabolic reflector 320 and a portion 340 that spills over as wasted energy. In a receive mode, the signal-to-noise ratio may decrease due to spillover portion 340 of the radiation pattern 330 between the parabolic reflector 320 and the RF feed 310. In a transmit mode, the spillover portion 340 of the radiation pattern 330 may be wasted energy and/or contribute to undesirable sidelobes and/or scattering.

Figure 4:
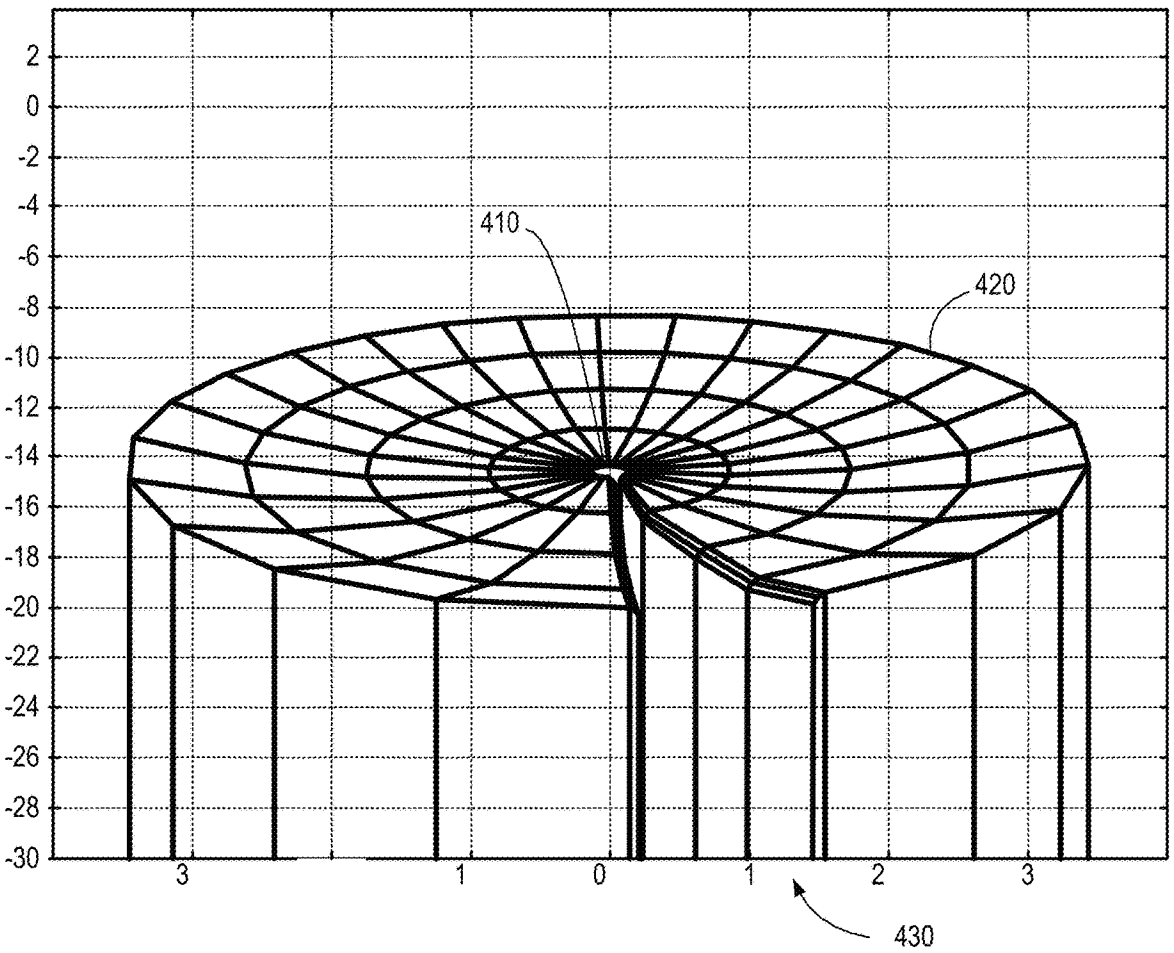
FIG. 4 illustrates a three-dimensional graph of a power density on a reflector with a notch in the power density to produce a strategic null.

FIG. 4 illustrates a three-dimensional graph 400 of a power density on a reflector with a notch in the power density to produce a strategic notched null 430. In addition to the notched null 430, the power density may be relatively higher near the edges 420 and lower near the center 410. The notched null 430 may correspond to, for example, the physical support and the feed horn of a parabolic antenna system.

As previously noted, a holographic lens with a distribution of dielectric constants may be utilized to modify the radiation pattern between a wide variety of types and configuration of antenna systems that include EMR feeds and reflectors.

Figure 5A:
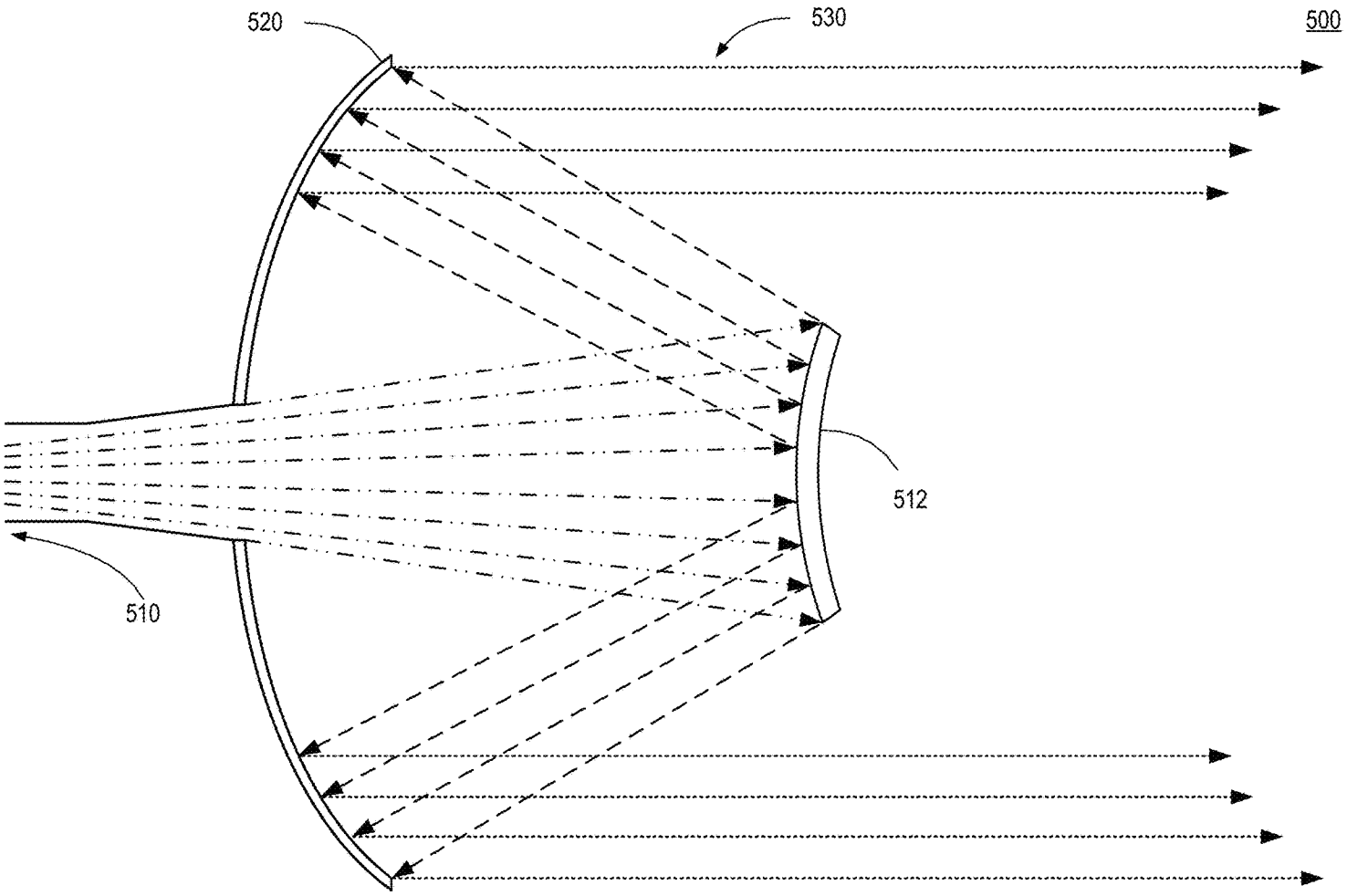
FIG. 5A illustrates a Cassegrainian reflector with a uniform radiation pattern.

FIG. 5A illustrates a Cassegrainian reflector 500 with an EMR feed 510, a first reflector 512, and a second reflector 520. A uniform radiation pattern 530 is illustrated to demonstrate the functionality of the Cassegrainian reflector 500 in a transmit mode.

Figure 5B:
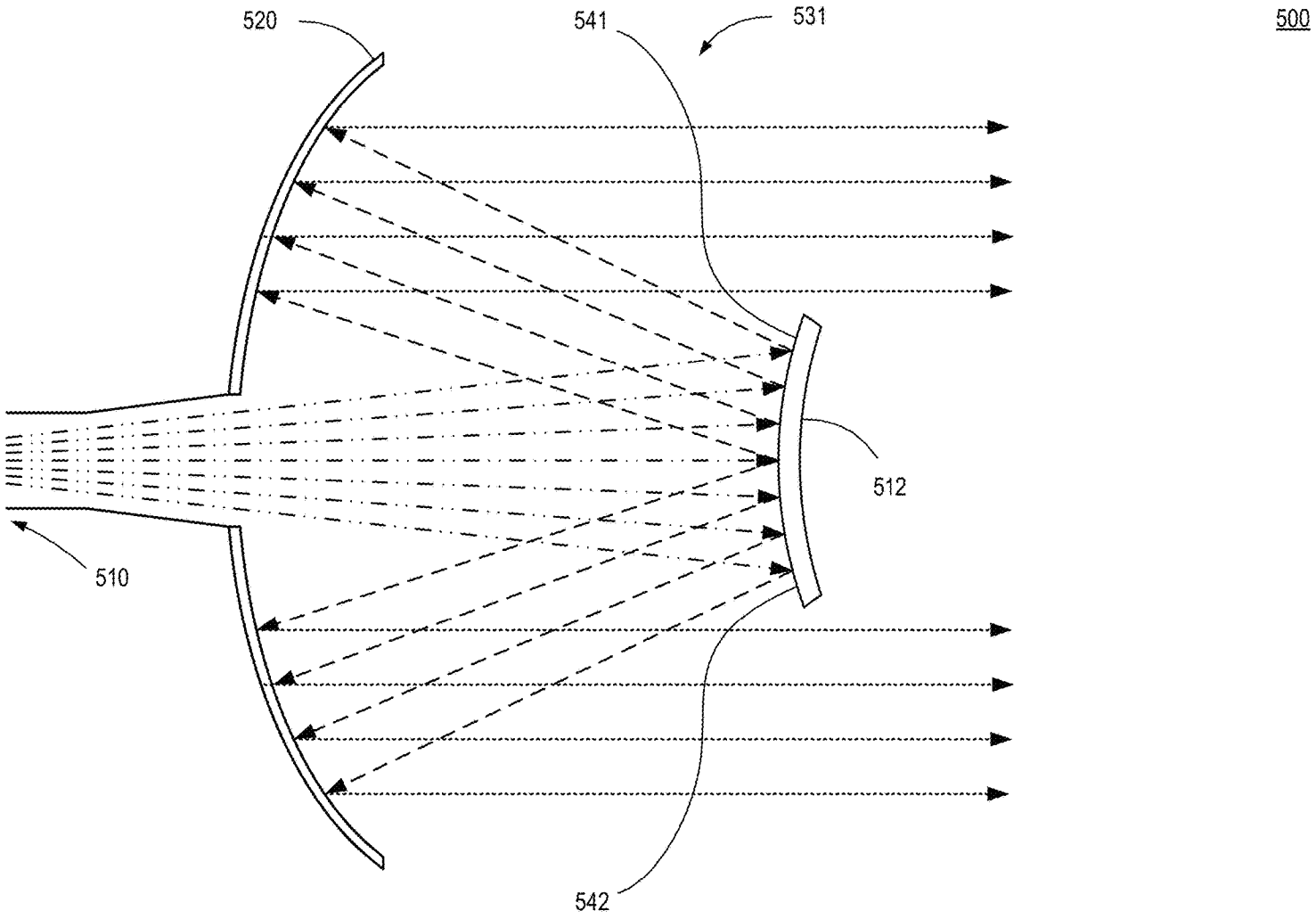
FIG. 5B illustrates a Cassegrainian reflector with an inefficient radiation pattern.

FIG. 5B illustrates the Cassegrainian reflector 500 with an inefficient radiation pattern 531 in which the edges 541 and 542 (e.g., a ring around the edge) of the first reflector 512 is not fully utilized. Consequently, the Cassegrainian reflector 500 has a narrower effective aperture.

Figure 5C:
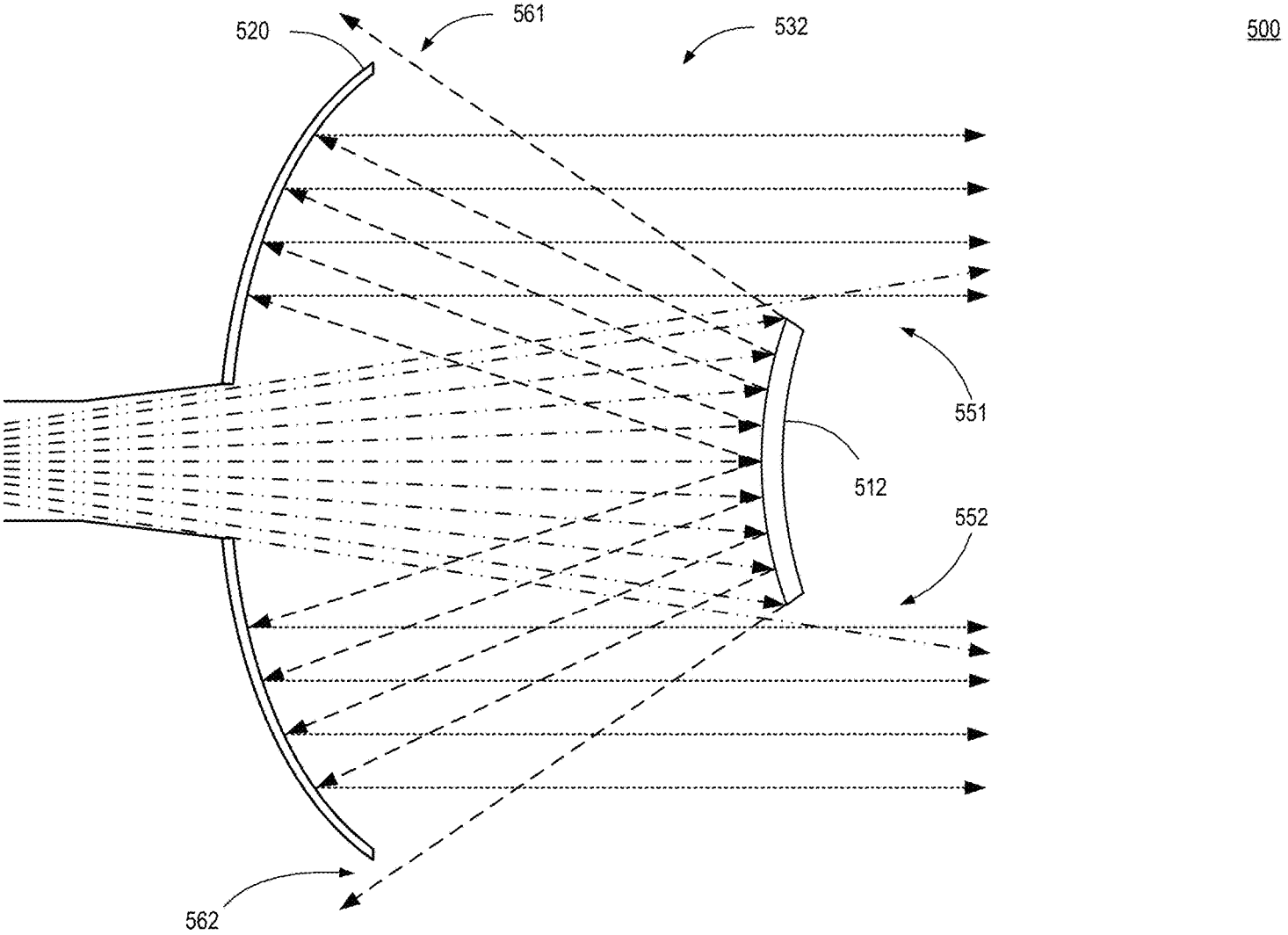
FIG. 5C illustrates a Cassegrainian reflector with another inefficient radiation pattern.

FIG. 5C illustrates the Cassegrainian reflector with another inefficient radiation pattern 532 in which an attempt to maximize the effective aperture (given the physical constraints of the device) results in significant spillover 551 and 552 at the first reflector 512 and/or spillover 561 and 562 at the second reflector 520.

Figure 6:
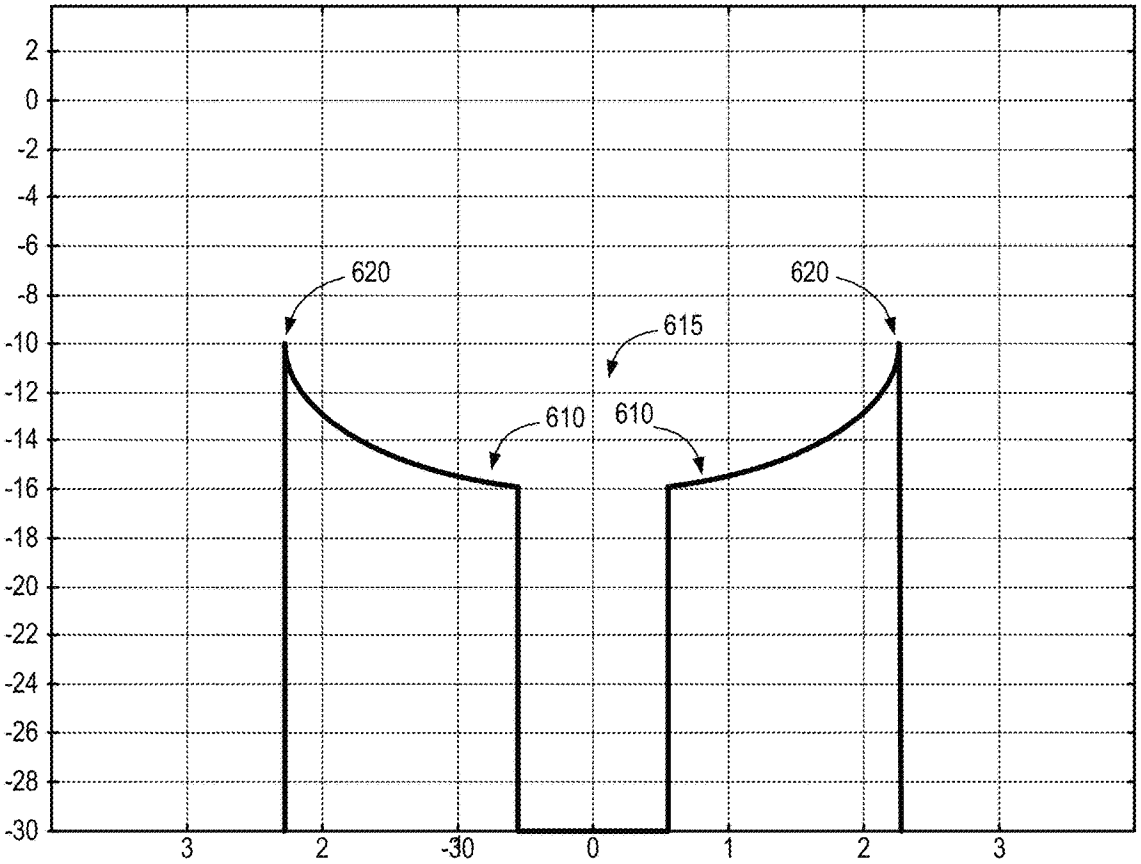
FIG. 6 illustrates an example of a possible distribution of power of a radiation pattern between an RF feed and a reflector using a holographic lens to create a null in the center of a reflector.

FIG. 6 illustrates another example of a possible distribution of power of radiation pattern 600 between an RF feed and a reflector using a holographic lens to create a null 615 in the center of a reflector. A center ring 610 outside of the null 615 may have a lower power density than the edges 620 of the radiation pattern.

Figure 7:
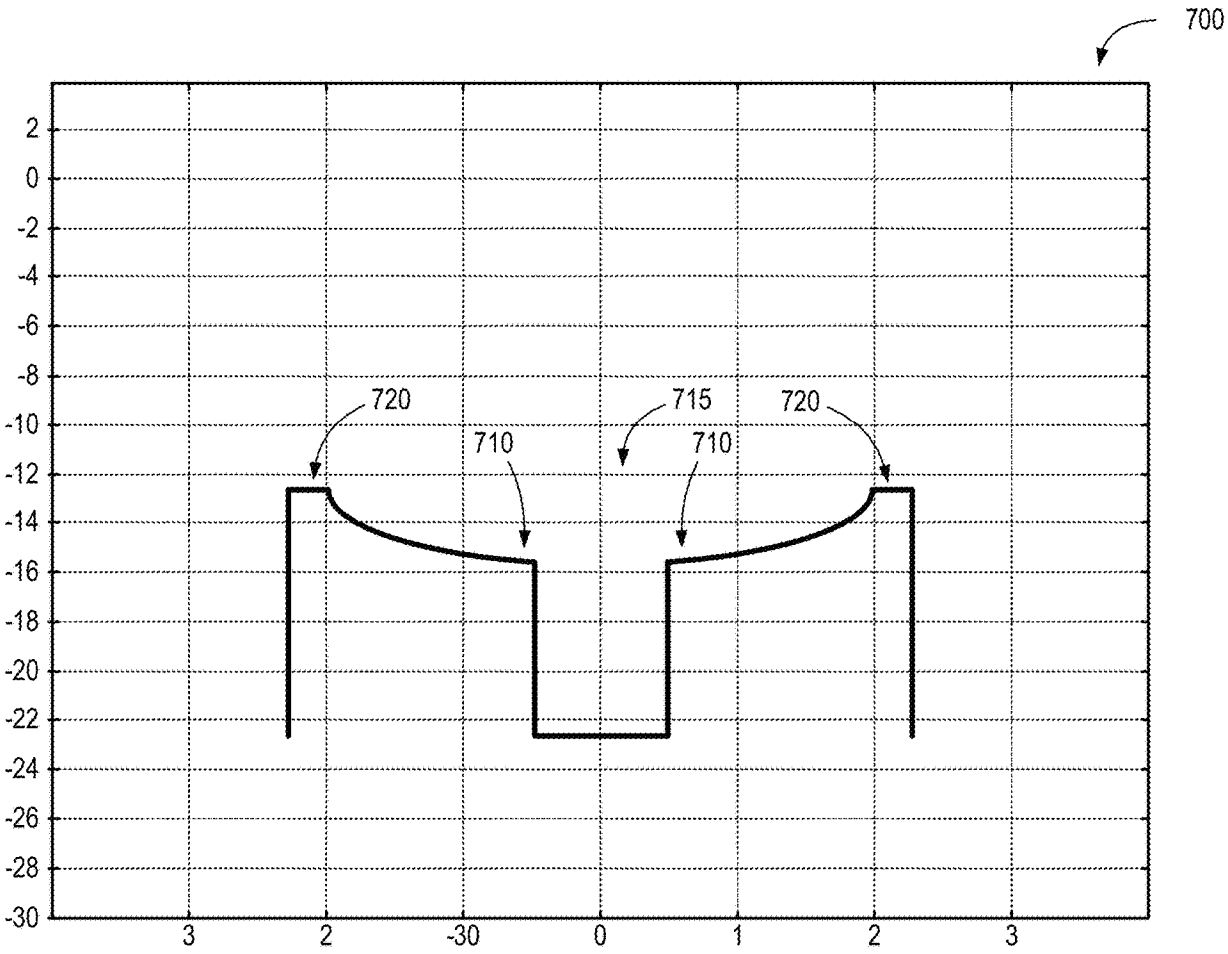
FIG. 7 illustrates another example of a possible distribution of power of a radiation pattern between an RF feed and a reflector using a holographic lens.

FIG. 7 illustrates another example of a possible distribution of power of radiation pattern 700 between an RF feed and a reflector using a holographic lens. In the illustrated embodiment, a quasi-null 715 is formed near the center and the power density increases from a center ring 710 to an outer edge 720 where it plateaus before falling off sharply to avoid spillover.

Figure 8:
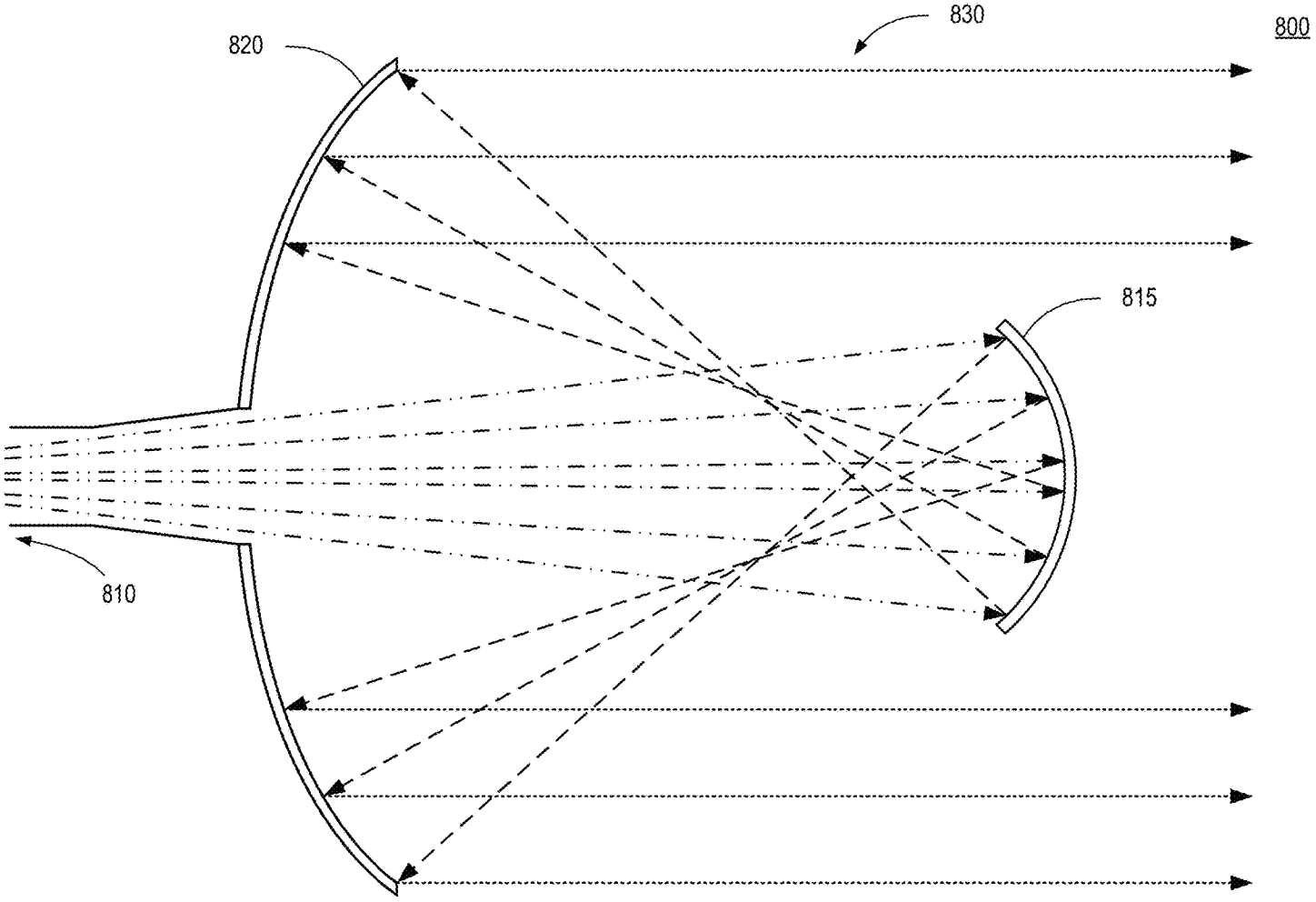
FIG. 8 illustrates a Gregorian reflector and RF feed with a uniform radiation pattern.

FIG. 8 illustrates a Gregorian antenna 800 that includes a first concave reflector 815, a second concave reflector 820, and an RF feed 810. The illustrated embodiment shows a reflection path using an idealized uniform radiation pattern 830.

Figure 9:
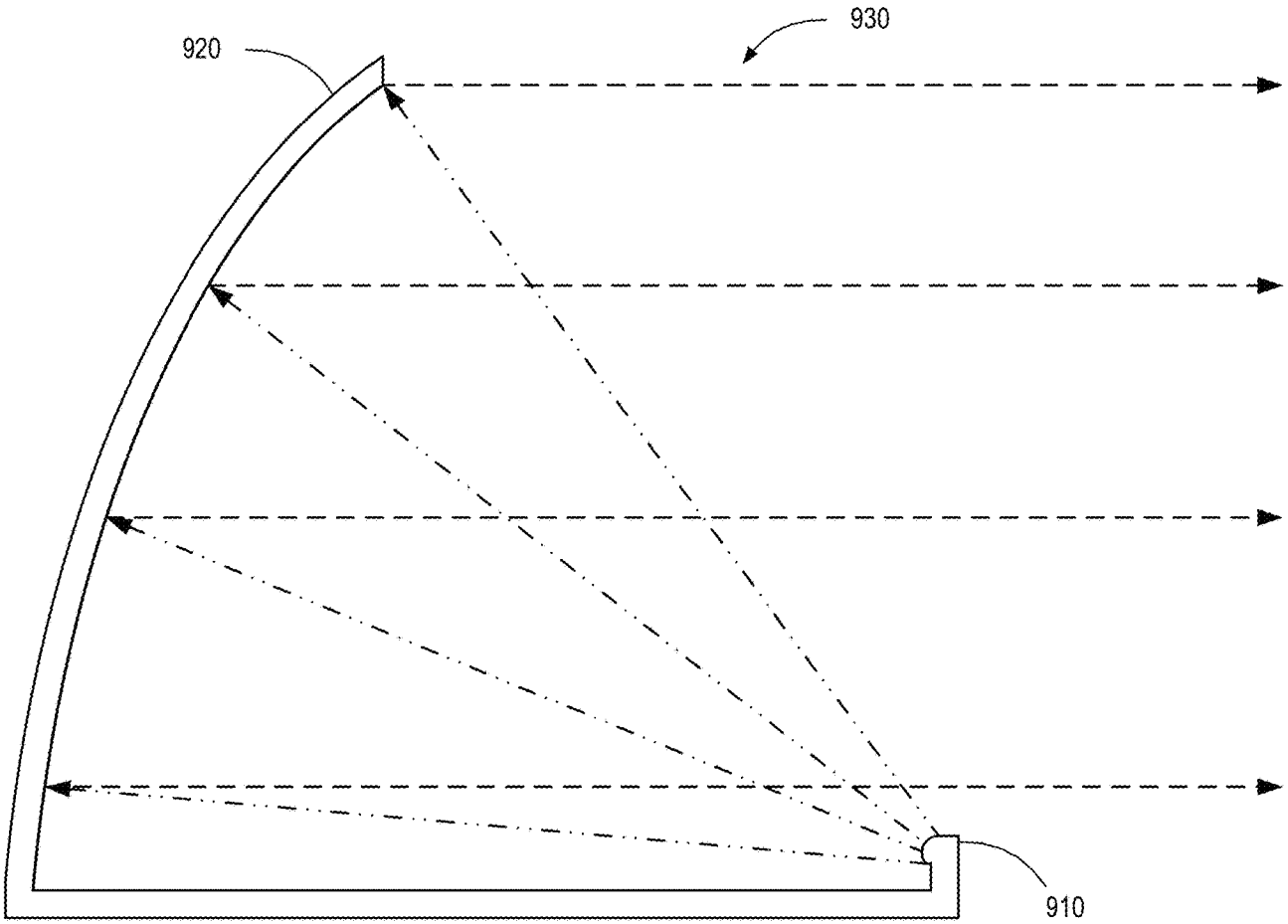
FIG. 9 illustrates a parabolic reflector with an offset RF feed with a uniform radiation pattern.

FIG. 9 illustrates a parabolic reflector 920 with an offset RF feed 910. A radiation pattern 930 of the offset RF feed 910 is not blocked by the RF feed 910 or any supporting hardware.

One or more holographic lenses can be used with any of the above-described antenna configurations, including the Gregorian antenna 800 and the offset RF feed 910 in FIGS. 8 and 9, respectively. A holographic lens may be used, as previously described, to improve efficiency, reduce scatter, create a null in a radiation pattern corresponding to blockage, reduce spillover, and/or more fully utilize an outer edge or edges of a reflector to increase the effective aperture of an antenna system.

Figure 10A:
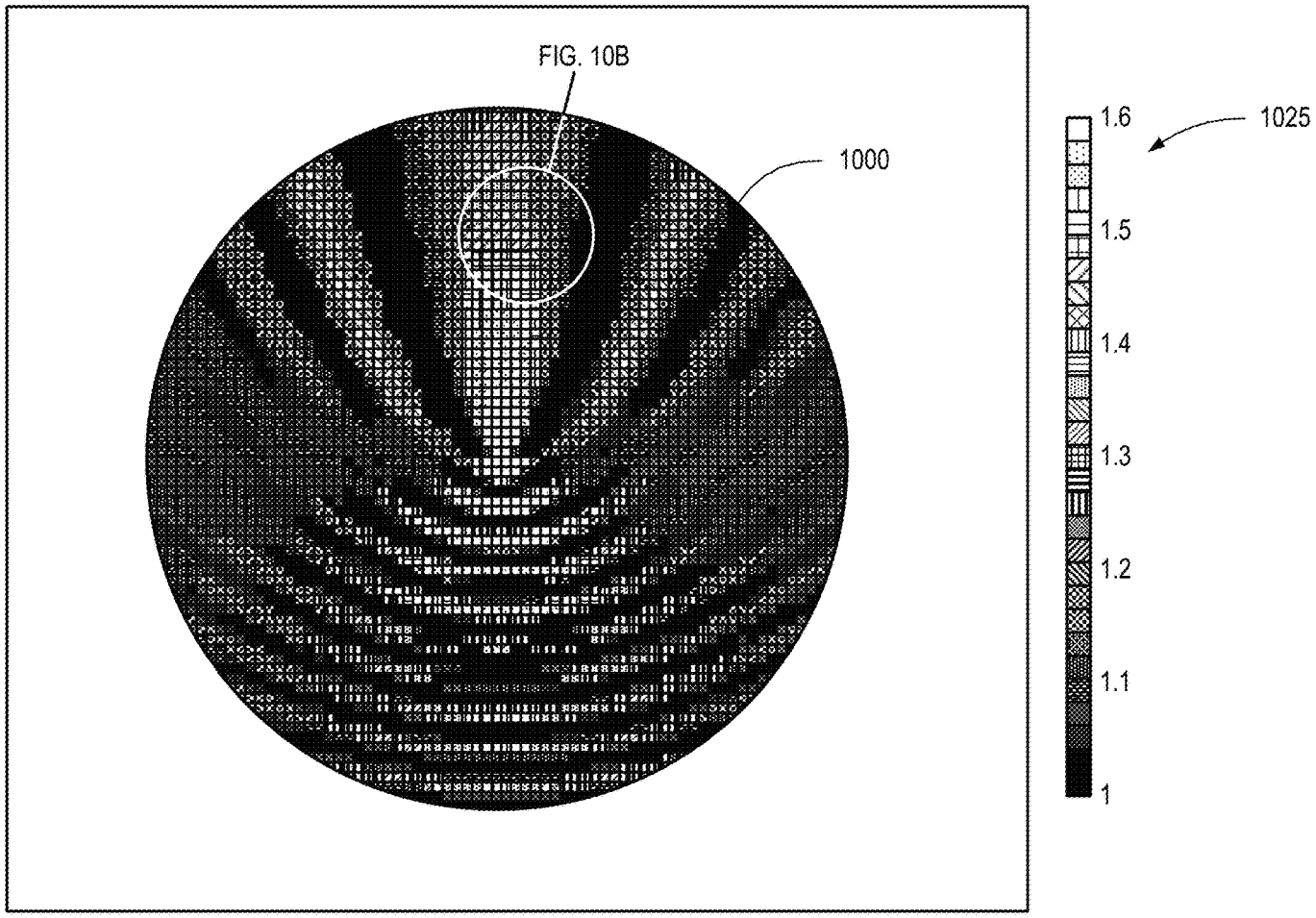
FIG. 10A illustrates a holographic lens with discrete sub-wavelength voxels of varying dielectric constants.

FIG. 10A illustrates an example of a holographic lens 1000 with discrete subwavelength voxels of varying dielectric constants described in legend 1025. In the illustrated embodiments, the dielectric constants in legend 1025 are shown varying from 1 to 1.6. In other embodiments, dielectric constants above 1.6 may be utilized. In some embodiments, metamaterials may be utilized to include dielectric constants below 1.

In the illustrated embodiment, the grayscale patterns in each of the boxes may each represent one of N discrete permittivity values, in which case the voxels are shown as relatively large for illustrative purposes. Alternatively, the grayscale patterns may represent a ratio of underlying binary permittivity values, in which case the individual boxes may represent averaged regions of tens, hundreds, or even thousands of underlying voxels.

FIG. 10A may be thought of as representing a distribution of dielectric constants discretized into 29 unique permittivity values with a few hundred voxels in the entire image. Alternatively, legend 1025 may be thought of as representing 29 possible ratios of permittivity values in a binary discretization with a few hundred regions shown in the image, in which each region comprises a plurality of underlying voxels whose permittivity values have been averaged.

Figure 10B:
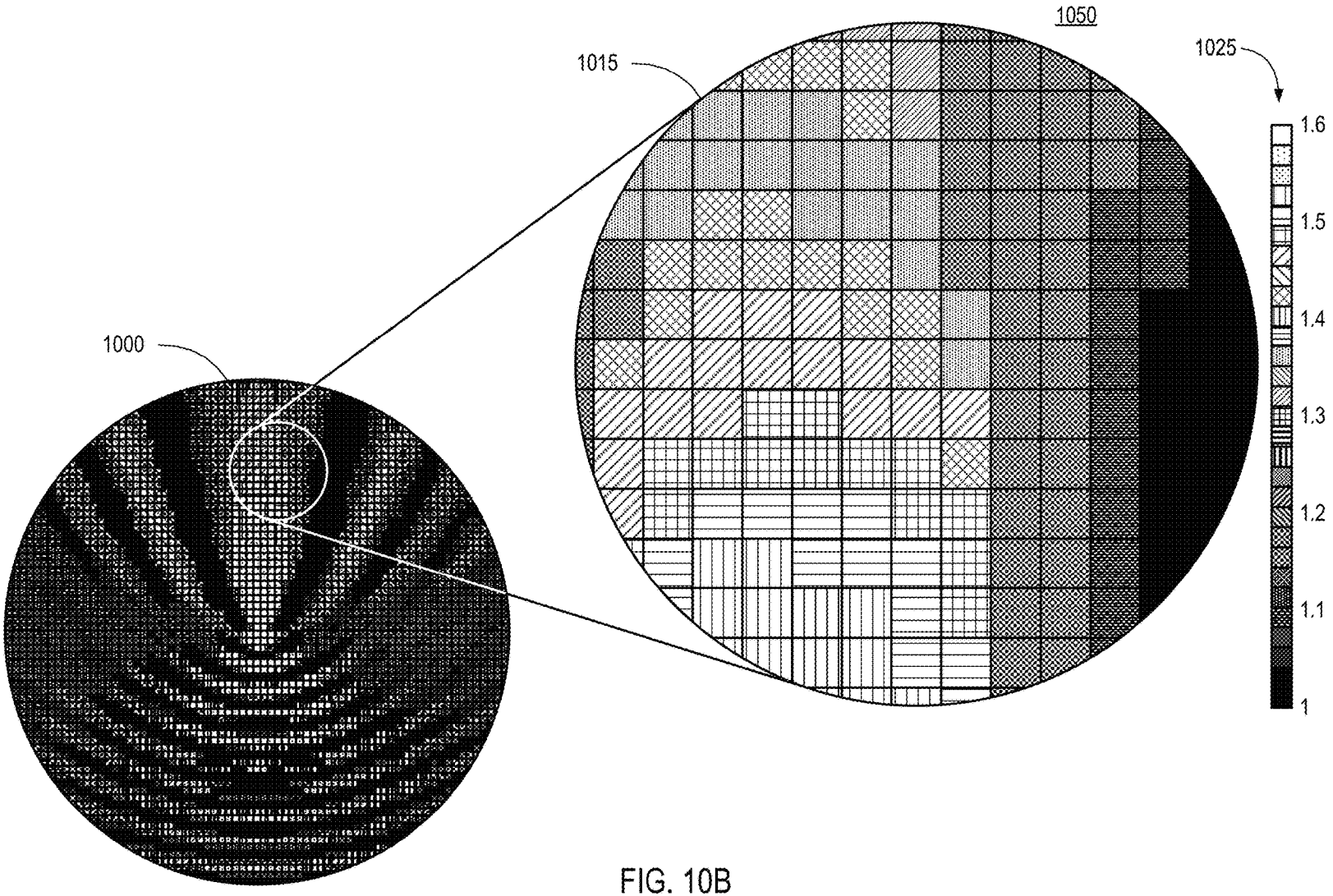
FIG. 10B illustrates a close-up view of a portion of FIG. 10A.

FIG. 10B illustrates a close-up view 1050 of a portion of FIG. 10A. The holographic lens 1000 is shown to include sub-wavelength voxels 1015 and includes explanatory legend 1025.

Figure 10C:
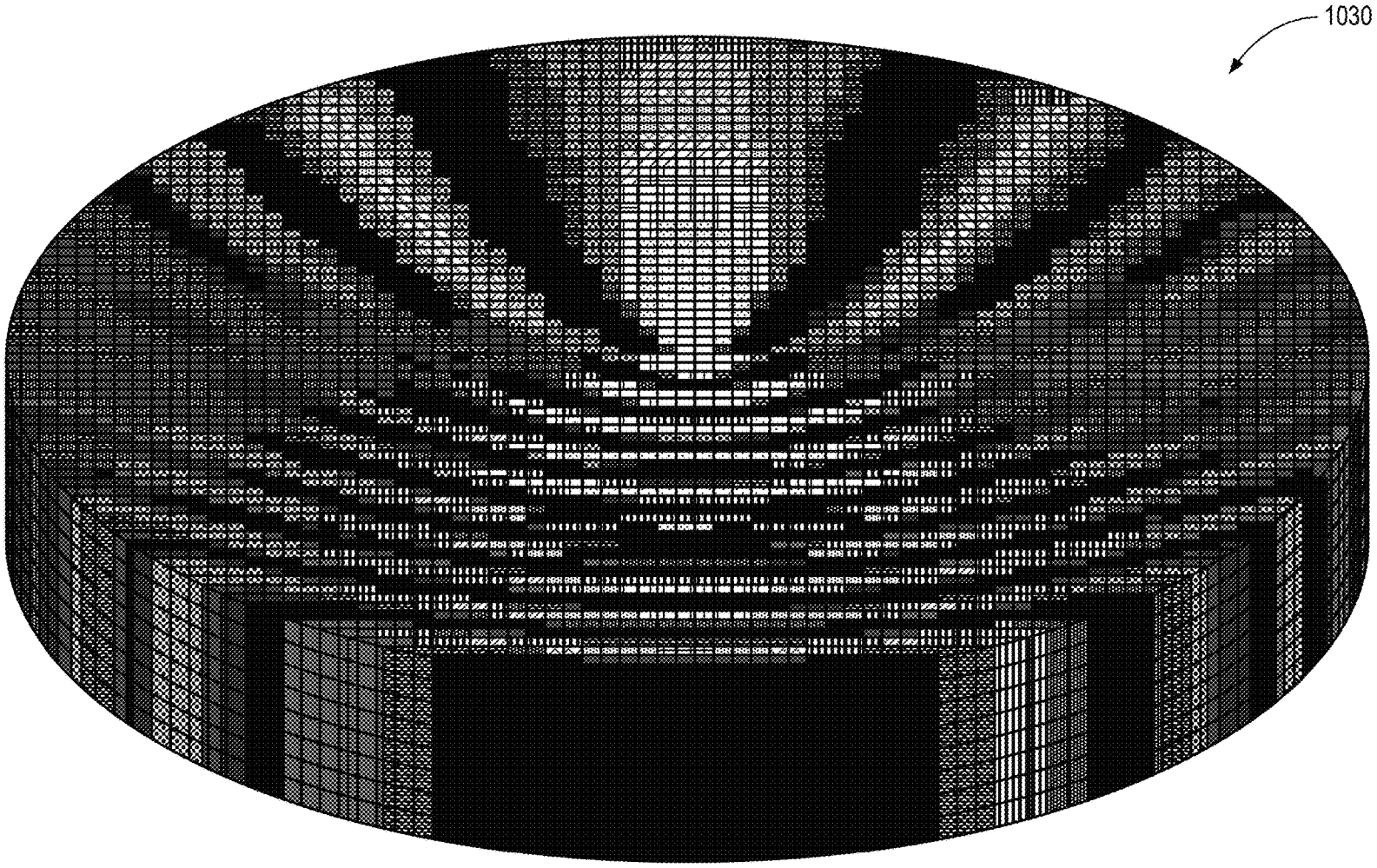
FIG. 10C illustrates a representation of a possible embodiment of a cylindrical holographic lens with individual voxels assigned discrete dielectric constants.

FIG. 10C illustrates a representation of a possible embodiment of a cylindrical mode-converting structure 1030 with individual voxels assigned discrete dielectric constants.

Figure 11:
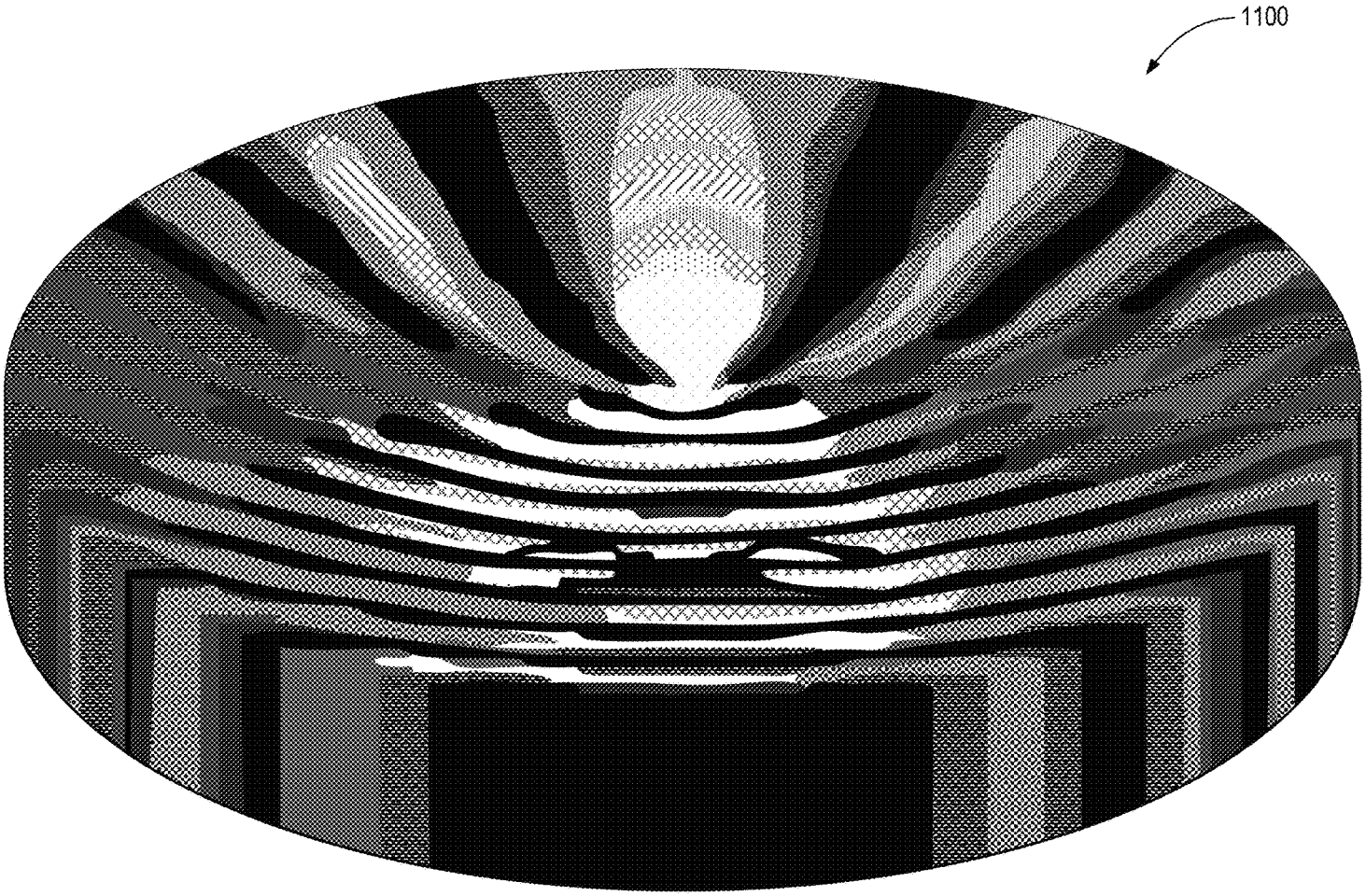
FIG. 11 illustrates a representation of the effective distribution of dielectric constants of the holographic lens for voxels with sub-wavelength dimensions.

FIG. 11 illustrates a representation of the effective distribution of dielectric constants of the holographic lens 1100 for voxels with sub-wavelength dimensions. As illustrated, if the feature sizes of each voxel are small enough, the discretized distribution of dielectric constants closely approximates (and may, for purposes of a given bandwidth of an EMR antenna, be functionally equivalent to) a continuous distribution of dielectric constants. To facilitate manufacturing, it may be beneficial to discretize the distribution of dielectric constants to include N discrete values, where N is selected based on the manufacturing technique employed, the number of available dielectric materials, and/or the homogeneous or heterogeneous nature of such dielectrics.

One method of generating the mode-converting structure comprises using a three-dimensional printer to deposit one or more materials having unique dielectric constants. As described above, each voxel may be assigned a dielectric constant based on the calculated distribution of dielectric constants. The three-dimensional printer may be used to "fill" or "print" a voxel with a material corresponding to (perhaps equal to or approximating) the assigned dielectric constant.

Three-dimensional printing using multiple materials may allow for various dielectric constants to be printed. In other embodiments, spaces or voids may be formed in which no material is printed. The spaces or voids may be filled with a fluid or a vacuum, or ambient fluid(s) may enter the voids (e.g., air).

In some embodiments, a multi-material three-dimensional printer may be used to print each voxel using a mixture or combination of multiple materials. The mixture or combination of multiple materials may be printed as a homogeneous or heterogeneous mixture. In embodiments in which a homogeneous mixture is printed, the printer resolution may be approximately equal to the voxel size. In embodiments in which a heterogeneous mixture is printed, the printer resolution may be much smaller than the voxel size and each voxel may be printed using a combination of materials whose average dielectric constant approximates the assigned dielectric constant for the particular voxel.

In some embodiments, the holographic lens may be divided into a plurality of layers. Each of the layers may then be manufactured individually and then joined together to form the holographic lens. Each layer may, in some embodiments, be formed by removing material from a plurality of voxels in a solid planar layer of material having a first dielectric constant.

The removed voxels may be filled with one or more materials having one or more distinct dielectric constants. In some embodiments, the holographic lens may be rotationally symmetrical such that it can be manufactured by creating a first planar portion and rotating it about an axis.

As described above, a binary discretization may result in a plurality of voxels, each of which is assigned one of two possible permittivity values. The resolution and size of the voxels selected may be based on the wavelength size of the frequency range being used.

In some embodiments, one of the two discrete dielectric constants may be approximately 80. Another of the dielectric constants may be approximately equal to a dielectric constant of distilled water at a temperature between 0 and 100 degrees Celsius. In some embodiments, one of the two discrete dielectric constants and/or a third dielectric constant may be approximately 1, such as air. As may be appreciated, the usage of a finite number of materials having a finite number of unique dielectric constants and/or the usage of voxels having a non-zero size may result in a holographic lens being fabricated that only approximates a calculated continuous distribution of dielectric constants for a target radiation pattern.

Any of a wide variety of materials and methods of manufacturing may be employed. For example, a holographic lens may be manufactured, at least in part, using glass-forming materials, polymers, metamaterials, aperiodic photonic crystals, silica, composite metamaterials, porous materials, foam materials, layered composite materials, stratified composite materials, fiber-bundle materials, micro-rod materials, nano-rod materials, a non-superluminal low loss dielectric material, porcelain, glass, plastic, air, nitrogen, sulfur hexafluoride, parylene, mineral oil, ceramic, paper, mica, polyethylene, and aluminum oxide.

The holographic lens may be fabricated by heating a material above a glass transition temperature and extruding a molten form of the material through a mask, which may be a rigid mask. Any other fabrication method or combination of fabrication techniques may be used, including injection molding, chemical etching, chemical deposition, heating, ultrasonication, and/or other fabrication techniques known in the art.

A non-superluminal low-loss dielectric (NSLLD) material may have a phase velocity for electromagnetic waves at a relevant frequency range that is less than c, where c is the speed of light in a vacuum. Metamaterials may be used as effective media with dielectric constants less than 1 for a finite frequency range, and more than one type or configuration of metamaterial may be used that has unique dielectric constants. Various metamaterials may be used that have complex permittivity values. The complex permittivity values may function as an effective-gain medium for a relevant frequency range and/or may correspond to a negative imaginary part of the effective dielectric constant for the relevant frequency range.

The holographic lens may be manufactured to have a width and/or length similar to or corresponding to that of the EMR feed, the EMR reflector, and/or a dimension of a space between the EMR feed and reflector. In various embodiments, the holographic lens may have a thickness that is less than one wavelength or a fraction of a wavelength of a frequency within a relevant frequency range for a particular EMR antenna. In other embodiments, the holographic lens may have a thickness equivalent to several or even tens of wavelengths. The thickness of the holographic lens may be uniform or non-uniform and may be substantially flat, rectangular, square, spherical, disc-shaped, parabolic in shape, or have another shape or profile for a particular application or to correspond to a particular EMR antenna.

As previously described, the holographic lens may be manufactured to have a distribution of dielectric constants, or an approximation thereof, to attain a target radiation pattern.

Figure 12A:
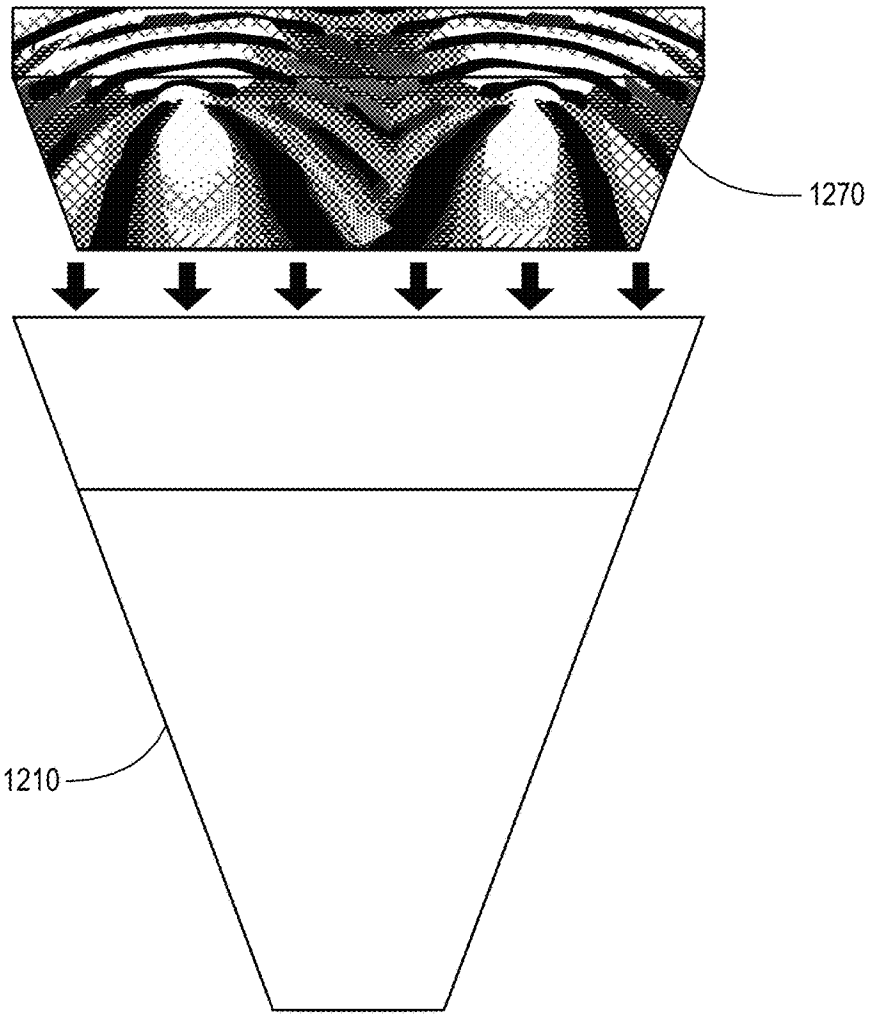
FIG. 12A illustrates an example of a holographic lens optimized with a binary volumetric distribution of dielectric constants to be inserted into an RF feed horn.

FIG. 12A illustrates an example of a holographic lens 1270 optimized with a binary volumetric distribution of dielectric constants to be inserted into an RF feed horn 1210.

Figure 12B:
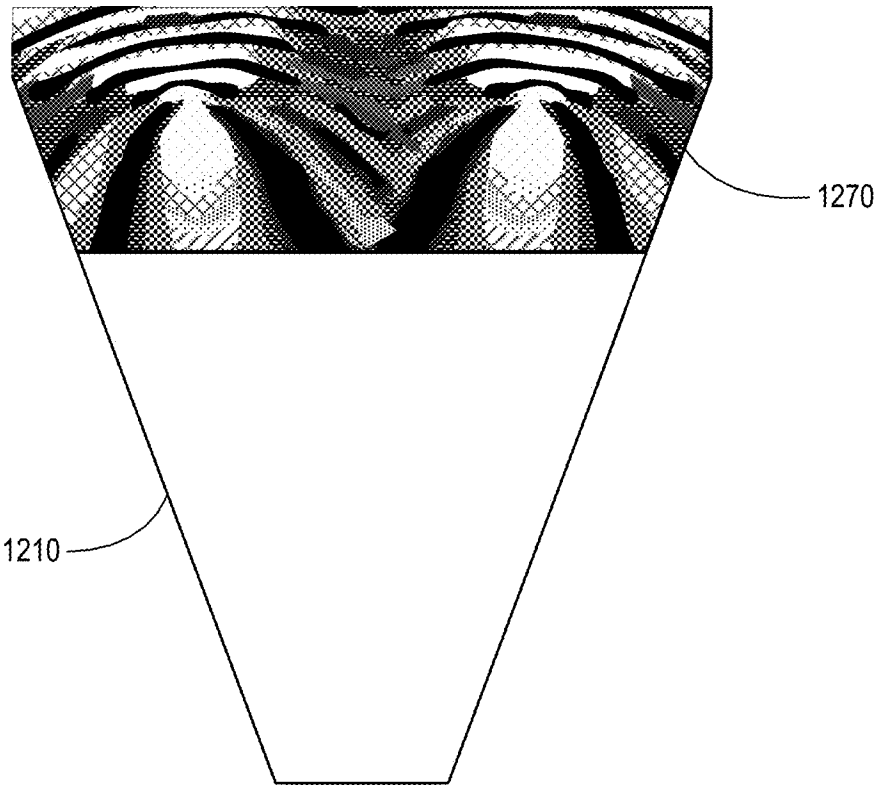
FIG. 12B illustrates the binary optimized holographic lens inserted into the RF feed horn.

FIG. 12B illustrates the binary optimized holographic lens 1270 inserted into the RF feed horn 1210.

Figure 13A:
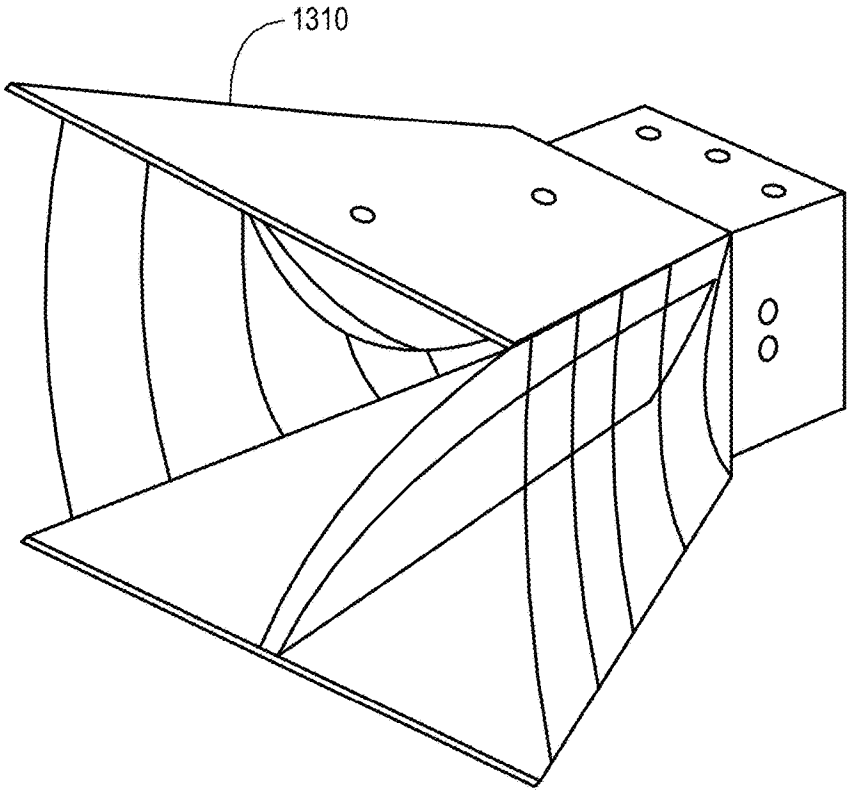
FIG. 13A illustrates an example of a holographic lens configured to fit over a portion of an RF feed horn.
Figure 13A:
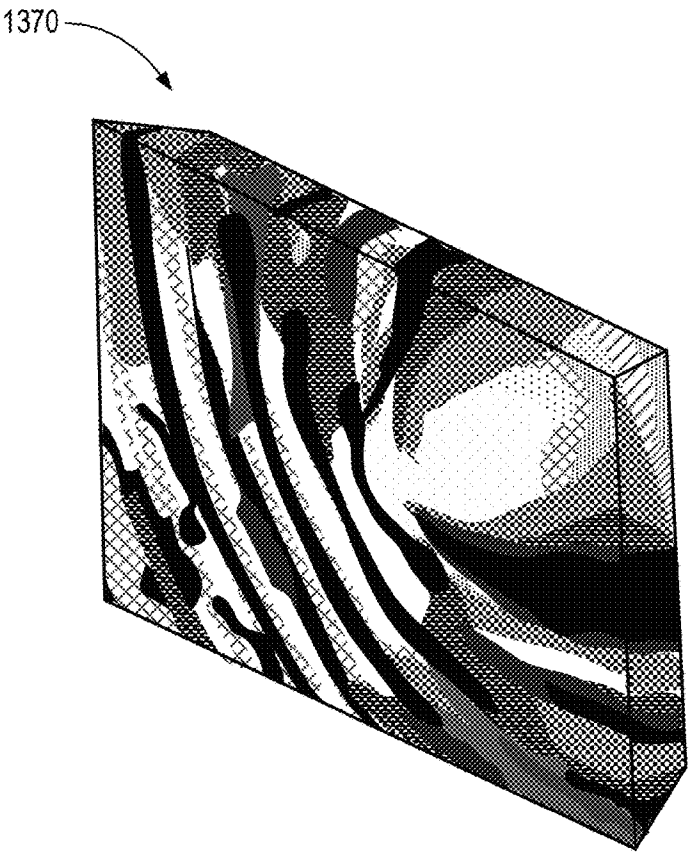

FIG. 13A illustrates another example of a holographic lens 1370 configured to fit over a portion of an RF feed horn 1310.

Figure 13B:
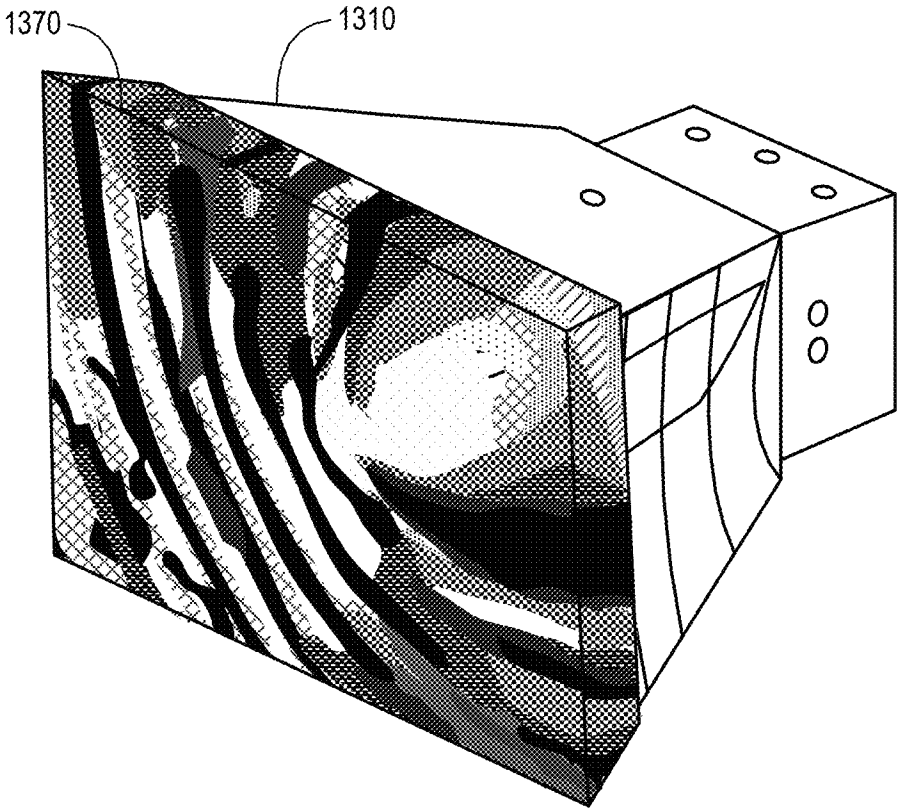
FIG. 13B illustrates the holographic lens fitted onto the RF feed horn.

FIG. 13B illustrates the holographic lens 1370 fitted onto the RF feed horn 1310.

Figure 14A:
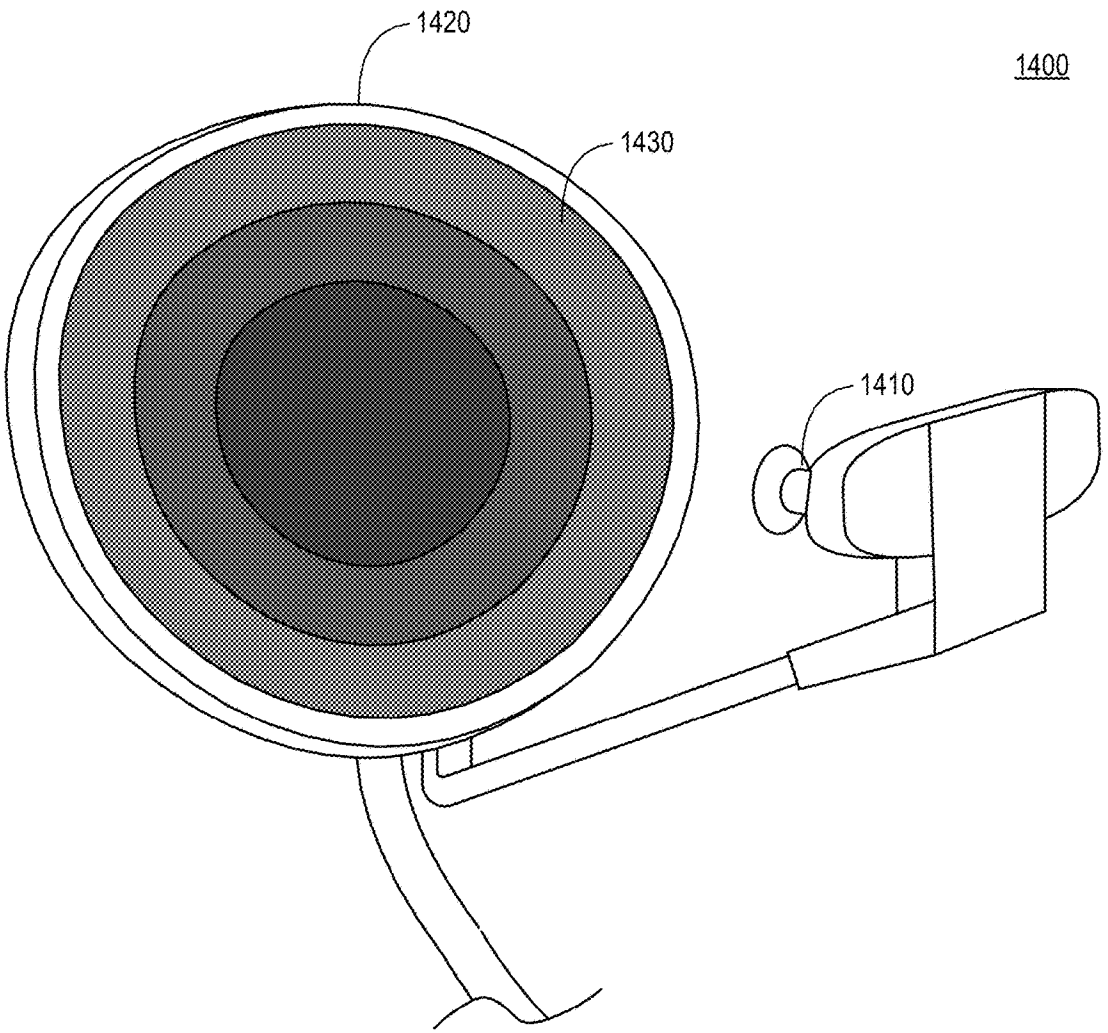
FIG. 14A illustrates a distribution of power of a standard radiation pattern between a parabolic reflector and an RF feed.

FIG. 14A illustrates a distribution of power 1430 of a standard radiation pattern between a parabolic reflector 1420 and an RF feed 1410 of an RF antenna system 1400. As in previous embodiments, the darker shading is used to represent higher magnitudes and the lighter shading is used to represent lower magnitudes. A Gaussian-approximation is illustrated in which the center of the parabolic reflector 1420 has the highest power density and the distribution of power 1430 tapers off toward the edges.

The more uniform the power density is across the diameter of the parabolic reflector 1420, the more spillover energy is lost. Conversely, the more focused the power density is toward the center of the parabolic reflector 1420, the less spillover energy is lost by the far-field focusing ability of the antenna system 1400.

Figure 14B:
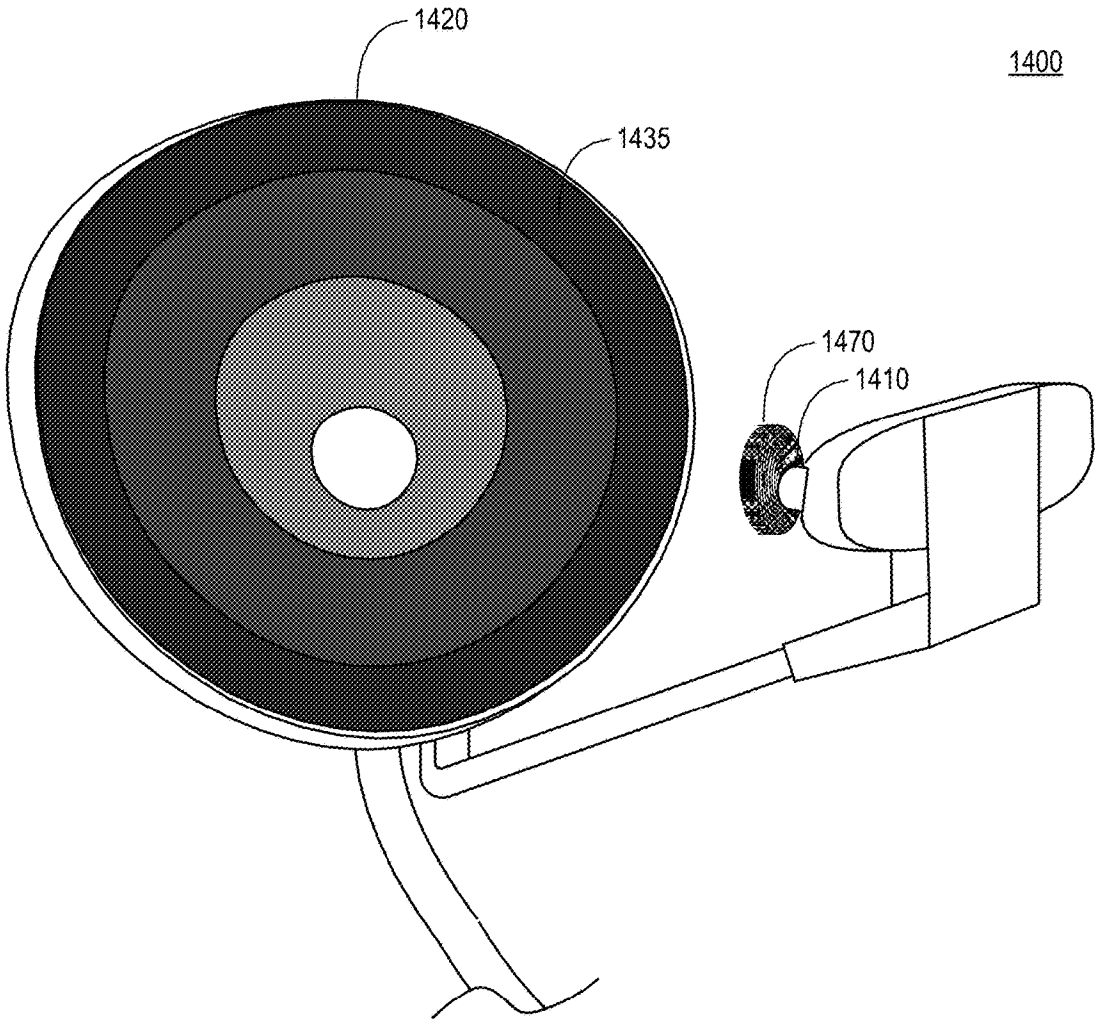
FIG. 14B illustrates a distribution of power of a modified radiation pattern between a parabolic reflector and an RF feed fitted with a holographic lens.

FIG. 14B illustrates a distribution of power 1435 of a modified radiation pattern between the parabolic reflector 1420 and the RF feed 1410 fitted with a holographic lens 1470. The holographic lens 1470 may modify the radiation pattern to include a null in the power density near the center (a portion that may be blocked by the RF feed 1410 and supporting structure) and increase in intensity toward the outer edges of the parabolic reflector 1420. The modified radiation pattern with the illustrated distribution of power 1435 may more fully utilize the effective aperture of the antenna system 1400, thereby increasing overall directivity. The holographic lens 1470 may also have reduced spillover for the given power density at the edges of the parabolic reflector 1420.

Many existing computing devices and infrastructures may be used in combination with the presently described systems and methods. Some of the infrastructure that can be used with embodiments disclosed herein is already available, such as general-purpose computers, computer programming tools and techniques, digital storage media, and communication links. A computing device or controller may include a processor, such as a microprocessor, a microcontroller, logic circuitry, or the like. A processor may include one ore more special-purpose processing devices, such as application-specific integrated circuits (ASICs), programmable array logic (PAL), programmable logic array (PLA), programmable logic device (PLD), field-programmable gate array (FPGA), or other customizable and/or programmable device. The computing device may also include a machine-readable storage device, such as non-volatile memory, static RAM, dynamic RAM, ROM, CD-ROM, disk, tape, magnetic, optical, flash memory, or another machine-readable storage medium. Various aspects of certain embodiments may be implemented using hardware, software, firmware, or a combination thereof.

For example, a computing device may be configured to identify a target radiation pattern for a reflector antenna system that has an RF feed and an RF reflector. The computing device and/or an operator may identify boundaries of a three-dimensional volume to enclose a holographic lens. For example, the holographic lens may be fitted on, in, around, and/or otherwise proximate the RF feed. A computing device may be used to determine an input field distribution of electromagnetic radiation on a surface of the holographic lens relative to the RF feed.

A volumetric distribution of dielectric constants within the holographic lens may be calculated that will transform the input field distribution of electromagnetic radiation to an output field distribution of electromagnetic radiation that approximates the target radiation pattern at the reflector. Ultimately, the calculated distribution of dielectric constants for generation of the holographic lens may be shared or transmitted to a manufacturing device, facility, and/or entity.

The components of the disclosed embodiments, as generally described and illustrated in the figures herein, could be arranged and designed in a wide variety of different configurations. Furthermore, the features, structures, and operations associated with one embodiment may be applied to or combined with the features, structures, or operations described in conjunction with another embodiment. In many instances, well-known structures, materials, or operations are not shown or described in detail in order to avoid obscuring aspects of this disclosure.

The embodiments of the systems and methods provided within this disclosure are not intended to limit the scope of the disclosure but are merely representative of possible embodiments. In addition, the steps of a method do not necessarily need to be executed in any specific order, or even sequentially, nor do the steps need to be executed only once. As described above, descriptions and variations described in terms of transmitters are equally applicable to receivers, and vice versa.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. This disclosure should, therefore, be determined to encompass at least the following claims.

What is claimed is:

1. An electromagnetic radiation (EMR) conversion system for converting between electric power and EMR signals with an intermediary holographic lens, comprising:

an EMR beamformer to beamform incident EMR signals;

an EMR feed with a radiation pattern relative to the EMR beamformer, wherein the radiation pattern is associated with a performance metric of the EMR system; and a holographic lens with a volumetric distribution of dielectric constants positioned at least partially between the EMR beamformer and the EMR feed to modify the radiation pattern relative to the EMR beamformer to adjust the performance metric, wherein the holographic lens comprises at least two metamaterials, wherein each of the metamaterials has a different dielectric constant.

2. The device of claim 1, wherein the holographic lens comprises a plurality of subwavelength voxels, wherein each voxel has a maximum dimension that is less than half of a wavelength of a frequency within an operational frequency range of the reflector antenna device, and wherein each voxel is assigned one of a plurality of dielectric constants to approximate the distribution of dielectric constants of the holographic lens.

3. The device of claim 1, wherein at least one of the metamaterials has a complex permittivity value.

4. An electromagnetic radiation (EMR) conversion system for converting between electric power and EMR signals with an intermediary holographic lens, comprising:

an EMR beamformer to beamform incident EMR signals;

an EMR feed with a radiation pattern relative to the EMR beamformer, wherein the radiation pattern is associated with a performance metric of the EMR system; and a holographic lens with a volumetric distribution of dielectric constants positioned at least partially between the EMR beamformer and the EMR feed to modify the radiation pattern relative to the EMR beamformer to adjust the performance metric, wherein the holographic lens comprises a plurality of subwavelength voxels, wherein each voxel has a maximum dimension that is less than half of a wavelength of a frequency within an operational frequency range of the reflector antenna device, and wherein each voxel is assigned one of a plurality of dielectric constants to approximate the distribution of dielectric constants of the holographic lens.

5. The system of claim 4, wherein the EMR beamformer comprises at least one electromagnetic transmissive aperture.

6. The system of claim 5, wherein the at least one electromagnetic transmissive aperture comprises a lens.

7. The device of claim 5, wherein the holographic lens has a volumetric distribution of dielectric constants to decrease incident power density of the radiation pattern in a location on the EMR beamformer, relative to the mean power density.

8. The device of claim 7, wherein the location on the EMR beamformer with reduced incident power density corresponds to a known aperture blockage of the device.

9. The system of claim 4, wherein the EMR beamformer comprises at least one electromagnetic reflective aperture.

10. The system of claim 9, wherein the at least one electromagnetic reflective aperture comprises a reflectarray.

11. The device of claim 10, wherein the EMR beamformer comprises a dish.

12. The device of claim 9, wherein the EMR reflective aperture comprises a reflectarray with a plurality of reflective elements.

13. The device of claim 9, wherein the EMR beamformer comprises an RF reflector and the EMR feed comprises an RF feed horn.

14. The device of claim 13, wherein the holographic lens is configured to be attached or adjacent to the inner walls of the RF feed horn.

15. The device of claim 9, wherein the EMR beamformer comprises a polarized reflector to reflect polarized EMR signals.

16. The system of claim 4, wherein the EMR feed is configured to transmit EMR to EMR beamformer during EMR transmission by the EMR conversion system.

17. The system of claim 4, wherein the EMR feed is configured to collect EMR from the EMR beamformer during EMR reception by the EMR conversion system.

18. The device of claim 4, wherein the EMR conversion system comprises a radio frequency (RF) antenna for converting between radio frequency EMR and electric power.

19. The device of claim 4, wherein the performance metric comprises an equivalent isotropic radiated power (EIRP).

20. The device of claim 4, wherein the radiation pattern relative to the EMR beamformer tapers from a relatively high radiation intensity at a center region of the EMR beamformer to a relatively low radiation intensity at edges of the EMR beamformer, and wherein the volumetric distribution of dielectric constants of the holographic lens increases the uniformity of the radiation pattern of the EMR feed at the EMR beamformer.

21. The device of claim 4, wherein the holographic lens has a volumetric distribution of dielectric constants to reduce spillover of the radiation pattern at the EMR beamformer.

22. The device of claim 4, wherein the volumetric distribution of the holographic lens is approximately homogeneous in one spatial dimension in a coordinate system, such that the volumetric distribution is effectively two-dimensional.

23. The device of claim 4, wherein the volumetric distribution of dielectric constants is selected based on an equation for a holographic solution.

24. The device of claim 4, wherein each voxel is assigned a dielectric constant selected from one of two discrete dielectric constants, and wherein the holographic lens is printed using a three-dimensional printer configured to print each of the sub-wavelength voxels with one of two materials, where each material corresponds to one of the two discrete dielectric constants.

25. A method comprising:

identifying a target radiation pattern for an electromagnetic radiation (EMR) antenna system comprising an EMR beamformer;

identifying boundaries of a three-dimensional volume to enclose a holographic lens relative to an EMR feed and the EMR beamformer;

determining an input field distribution of EMR on a surface of the holographic lens relative to the EMR feed used to approximate the target radiation pattern via the EMR beamformer;

calculating a volumetric distribution of dielectric constants within the holographic lens that will transform the input field distribution of EMR to an output field distribution of EMR that approximates the target radiation pattern with at least one performance metric improvement relative to the input field distribution used to approximate the target radiation pattern; and transmitting data containing the calculated volumetric distribution of dielectric constants for generation of the holographic lens.

26. The method of claim 25, wherein the volumetric distribution is fixed as approximately homogeneous in one spatial dimension in a coordinate system, such that the volumetric distribution of the holographic lens is effectively two-dimensional.

27. The method of claim 26, wherein the coordinate system is Cartesian, such that the volumetric distribution corresponds to a uniform extrusion of a planar two-dimensional distribution perpendicular to its plane.

28. The method of claim 26, wherein the coordinate system is cylindrical, such that the volumetric distribution corresponds to a uniform rotation of a two-dimensional planar cross section around a selected axis of revolution.

29. The method of claim 25, wherein the volume of the holographic lens is divided into a plurality of sub-wavelength voxels, wherein each voxel has a maximum dimension that is less than one-half-wavelength in diameter for the finite frequency range, and wherein each voxel is assigned a dielectric constant based on the determined distribution of dielectric constants for approximating the target field pattern.

30. The method of claim 29, further comprising generating the holographic lens with the voxels having the determined distribution of dielectric constants.

31. The method of claim 25, wherein the EMR beamformer comprises at least one electromagnetic transmissive aperture.

32. The method of claim 31, wherein the at least one electromagnetic transmissive aperture comprises a lens.

33. The method of claim 25, wherein the EMR beamformer comprises at least one electromagnetic reflective aperture.

34. The method of claim 33, wherein the at least one electromagnetic reflective aperture comprises a reflectarray.

35. The method of claim 25, further comprising generating the holographic lens having the determined distribution of dielectric constants.

36. The method of claim 35, wherein the holographic lens comprises at least two metamaterials, wherein each of the metamaterials has a different dielectric constant.

37. The method of claim 36, wherein at least one of the metamaterials has a complex permittivity value.

38. The method of claim 35, wherein the holographic lens comprises a plurality of subwavelength voxels, wherein each voxel has a maximum dimension that is less than half of a wavelength of a frequency within an operational frequency range of the reflector antenna device, and wherein each voxel is assigned one of a plurality of dielectric constants to approximate the distribution of dielectric constants of the holographic lens.

39. The method of claim 38, wherein each voxel is assigned a dielectric constant selected from one of two discrete dielectric constants.

40. The method of claim 39, wherein the holographic lens is printed using a three-dimensional printer configured to print each of the sub-wavelength voxels with one of two materials, where each material corresponds to one of the two discrete dielectric constants.

* * * * *